US010843095B2

(12) United States Patent
Paperno et al.

(10) Patent No.: US 10,843,095 B2
(45) Date of Patent: Nov. 24, 2020

(54) TRACK SYSTEM

(71) Applicant: Steven Paperno, Westlake Village, CA (US)

(72) Inventors: Steven Paperno, Westlake Village, CA (US); Joseph R. Adamski, Burbank, CA (US)

(73) Assignee: Steven Paperno, Westlake Village, CA (US)

( * ) Notice: Subject to any disclaimer, the term of this patent is extended or adjusted under 35 U.S.C. 154(b) by 344 days.

(21) Appl. No.: 15/901,334

(22) Filed: Feb. 21, 2018

(65) Prior Publication Data

US 2019/0255451 A1 Aug. 22, 2019

(51) Int. Cl.
*A63H 18/02* (2006.01)

(52) U.S. Cl.
CPC ..... *A63H 18/02* (2013.01)

(58) Field of Classification Search
CPC ..... A63H 18/02
USPC ..... 238/10 A, 10 E, 10 F; 104/DIG. 1
See application file for complete search history.

(56) References Cited

U.S. PATENT DOCUMENTS 2,919,515 A * 1/1960 Connell ..... A63H 19/30 238/10 R
D190,088 S * 4/1961 Tilli ..... D21/565
3,225,487 A * 12/1965 Mallalieu ..... A63H 18/02 446/127
3,480,210 A * 11/1969 Perrinjaquet ..... A63F 9/14 238/10 R
3,712,540 A * 1/1973 Yamasaki ..... A63H 18/02 238/10 E
3,734,404 A * 5/1973 Baynes ..... A63H 18/02 238/10 E
3,767,114 A * 10/1973 Rossi ..... A63H 19/30 238/10 E
3,834,067 A * 9/1974 Koleczek ..... A63H 33/084 446/69
4,146,991 A * 4/1979 Sano ..... A63H 18/028 446/430
4,352,329 A * 10/1982 Fetty ..... A63H 18/02 104/305
4,504,012 A * 3/1985 Fetty ..... A63H 18/12 104/305
4,826,076 A * 5/1989 Hesse ..... A63H 18/02 238/10 R
5,078,642 A * 1/1992 Glessner ..... A63F 7/386 4/546
5,118,320 A * 6/1992 Miller ..... A63H 18/02 104/245
5,779,145 A * 7/1998 Zelle ..... A63H 19/30 238/10 C
5,873,521 A * 2/1999 Ernst ..... A63H 18/00 104/126
6,009,812 A * 1/2000 Ernst ..... A63H 18/00 104/124

(Continued)

*Primary Examiner* — Zachary L Kuhfuss
(74) *Attorney, Agent, or Firm* — Knobbe Martens Olson & Bear LLP

(57) ABSTRACT

A kit for assembling a modular toy race track. The kit includes at least one generally U-shaped straight-track segment formed of folded paperboard, at least one generally U-shaped curved-track segment formed of molded plastic and at least one track connections formed of molded plastic for interconnecting a pair of track segments to form a raceway.

12 Claims, 30 Drawing Sheets

(56) References Cited

U.S. PATENT DOCUMENTS

| | | | | | |
|---|---|---|---|---|---|
| 6,093,079 | A * | 7/2000 | House | A63H 18/02 | 238/10 E |
| 6,170,754 | B1 * | 1/2001 | Halford | A63H 18/04 | 104/56 |
| 6,612,533 | B2 * | 9/2003 | Biles | B25H 3/006 | 248/354.1 |
| D630,262 | S * | 1/2011 | Hornsby | D21/484 | |
| 8,113,122 | B2 * | 2/2012 | Tarr | A63H 19/34 | 104/124 |
| D718,822 | S * | 12/2014 | Lee | D21/565 | |
| D723,108 | S * | 2/2015 | Schutt | D21/484 | |
| 9,120,028 | B2 * | 9/2015 | Wilson | A63H 33/062 | |
| 9,345,980 | B2 * | 5/2016 | Lee | A63H 18/02 | |
| 10,086,305 | B2 * | 10/2018 | Juliano | A63H 18/04 | |
| 2012/0272921 | A1 * | 11/2012 | Santarsiero | A01K 15/025 | 119/707 |
| 2016/0220916 | A1 * | 8/2016 | Bergan | A63H 18/02 | |
| 2016/0236109 | A1 * | 8/2016 | Juliano | A63H 18/04 | |
| 2018/0369705 | A1 * | 12/2018 | Tiffin | A63H 18/08 | |
| 2019/0255451 | A1 * | 8/2019 | Paperno | A63H 18/02 | |

* cited by examiner

TRACK SYSTEM

BACKGROUND

Field

This disclosure generally relates to modular, customizable toy track systems and kits for assembling customizable toy tracks systems.

Description of the Related Art

Modular toy track systems have existed for years and have been used to entertain children at many different ages. They can be used as raceways for rolling cars or other objects across floors, furniture, or outdoors. Such track systems can be modular and include variously shaped track members that can be connected together in a customizable fashion.

Generally, existing toy track systems are subject to several limitations and certain aspects of the present disclosure provide improvements to existing toy track system designs. For example, existing HOT WHEELS® brand track systems include plastic components that are complicated to assemble and prone to breaking, especially the small plastic members that are used as connection pieces between track members. Even during routine use, the plastic components can crack and render the track member unusable. Moreover, the cost to replace these broken parts (and the initial cost of overall track system) is relatively high because of the materials used.

Moreover, it can take very large numbers of track pieces to fill any sizeable play area. Existing track systems limit the scope of creative play that can be conducted by children because of the limited number of pieces provided in a given kit, the length and modularity of the components of the track systems, and the inability of the track systems to command the presence of a play area, in addition to other known limitations.

SUMMARY

According to one aspect of the present disclosure, a kit is provided that includes a plurality of modular track segments that can be assembled into a track system. The kit includes at least one straight track segment that provides a raceway for play cars or other toy objects. Each straight track segment is made out of a paperboard sheet. The sheet includes a plurality of fold lines whereby the straight track segment is formed by folding along the fold lines. The straight track segment includes a generally U-shaped channel. The U-shaped channel includes first and second folded sides and a bottom.

The kit includes at least one curved track segment. Each curved track segment has substantially the same dimensions (in cross section) as the U-shaped channel of the straight track segment. Each curved track segment is formed out of a molded plastic or a thermo-formed fiber pulp.

The kit includes at least one track connector for connecting at least two track segments (any combination of the straight and curved track segments) together. An end of each of the track segments is inserted into slots on opposite connection sides of the track connector to form a continuous raceway. Each of the slots is formed by a wall of the track connector and a wing portion spaced from the wall.

The kit includes one or more supports to provide support and elevation to the track connector and the raceway. The one or more supports couple with the track connector by one or more securing clips.

According to another aspect of the kit, a second straight track segment is insertable into one or more slots of the support. In this manner, the second straight track segment can be used to provide support and elevation to the track connector.

According to another aspect of the disclosure, a track assembly can be provided. The track assembly includes a connector with first and second connection sides. Two track segments are inserted into first and second connection sides, respectively. A first wing at least partially defines a first slot in which a first upright side of each of the two track segments is received. A second wing at least partially defines a second slot within which a second upright side of each of the two track segments is received. A central portion connects the first and second wings. The central portion supports a bottom of each of the two track segments. A support is clipped with the track connector. The support has first and second support ends coupled by a connecting portion. Each of the first and second support ends includes a securing clip that couples the support with the track connector.

According to another aspect of the disclosure, a kit is provided for assembling a race track. The kit includes a track connector. The track connector has a first side with a first slot that receives a first upright side of a first track segment and a second upright side of a second track segment. The track connector has a second side with a second slot for a second upright side of the first track segment and a second upright side of the second track segment. A central portion connects the first and second wings.

According to another aspect of the kit, the track connector has one or more pegs that couple with one or more holes on the first and second track segments.

According to another aspect of the kit, the first track segment has one or more pegs that couple with one or more flexible eyelets on the track connector.

According to another aspect of the kit, the first and second track segments are formed of paperboard and have one or more fold lines. The first and second upright sides are formed by folding along the one or more fold lines.

According to another aspect of the kit, the kit includes a support. The support has first and second support ends coupled by a connecting portion. Each of the first and second support ends includes a securing clip for coupling the support with the track connector.

According to another aspect of the kit, the support has one or more receiving slots that receive first and second upright sides of a third track segment at an angle orthogonal to the central portion of the track connector. The third track segment is formed of paperboard and has one or more fold lines. The first and second upright sides are formed by folds along the one or more fold lines.

According to another aspect of the kit, the track connector has a securing clip. The securing clip includes a tapered slot on each of the first and second sides of the connector and a tapered member on first and second ends of the support. The tapered slots receive the tapered members to couple the support and the connector.

According to another aspect of the kit, the track connector has an alignment ridge on the central portion that extends between the first and second wings.

DETAILED DESCRIPTION

Figure 1:
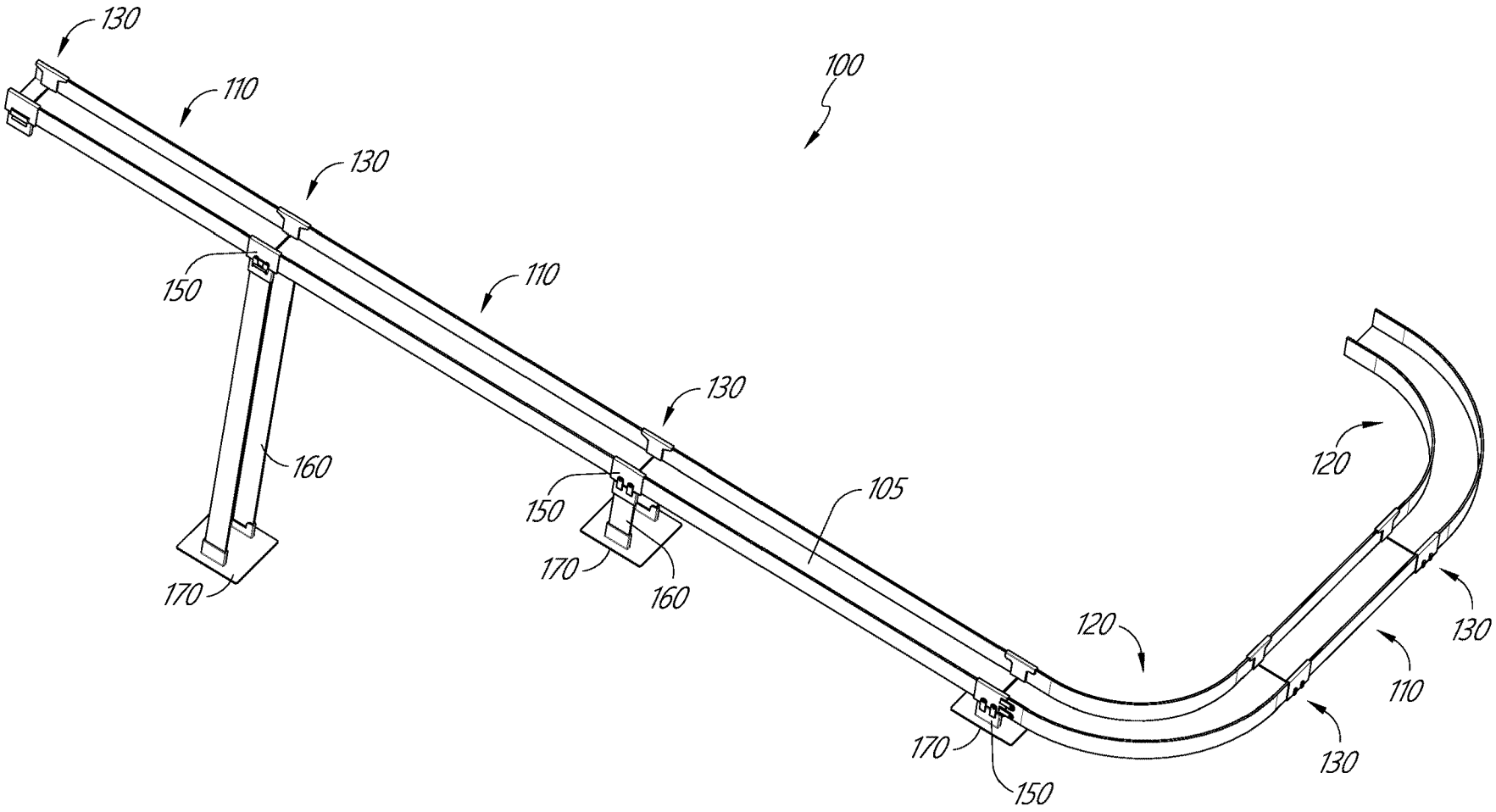
FIG. 1 illustrates a track assembly.

FIG. 1 illustrates a modular toy track system 100 in one assembled configuration. The track system 100 can include many different component parts that can be assembled together in various configurations according to the desires of an assembler (e.g., children or adults) who is assembling together the component parts. The track system 100, for example, can be assembled to form a continuous raceway 105 for supporting toy cars, trucks, marbles, balls, and other toy objects. The raceway 105 can extend within a room, through several rooms, over and under furniture, across floors, and/or out-of-doors. Moreover, the length and shape of the raceway 105 is only limited by the number of components parts that are assembled together and the creativity of the assemblers.

The component parts of the track system 100 can include one or more straight track segments 110, one or more curved track segments 120, one or more track connectors 130, one or more interchangeable supports 150, and various other components, as described herein. These component parts can be gathered together and packaged as a kit for assembling the track system 100. The number of configurations for the raceway 105 of even a simple kit containing only a few component parts is nearly endless. The kit can be marketed and sold as a unit. Numerous sizes and combinations of the component parts of the track system 100 can be packed into various different kits. The kits can, for example, be packaged within a sturdy container with a lid designed for long-term storage and reuse. Some kits can include only a single type of component part. Moreover, the component parts can be varied in length, color and materials to suit the desires of the potential buyers.

The raceway 105 can be formed by coupling together various track segments (e.g., straight track segments 110 and/or curved track segments 120) using the track connectors 130. By varying the configuration of the straight track segments 110 and the curved track segments 120 (e.g., including the lengths of the straight track segments 110) and using varying sizes and angles of the curved track segments 120, the assembly of the track system 100 can be made to fit the desires of any assembler.

The track system 100 can also include one or more interchangeable supports 150. The interchangeable supports 150 are used to couple with the one or more track connectors 130. The interchangeable supports 150 can add height and elevation to portions of the track system 100. In some configurations, the interchangeable supports 150 can further be coupled with one or more elongate support segments 160. The elongate support segments 160 can be used to add additional elevation to the raceway 105 through the track connectors 130. At least in some implementations of the track system 100, the elongate support segments 160 can be identical to the straight track segments 110 (e.g., the straight track segments 110 can alternatively be used as elongate support segments 160).

In some implementations, the track system 100 can include one or more base supports 170. The base support 170 can provide additional stability to the track system 100. The base supports 170 can couple with one end of each of the elongate support segments 160 and thereby stabilize the raceway 105. The base supports 170 and the elongate support segments 160 allow for the assembled components of the track system 100 (e.g., raceway 105) to be higher, more stable, and improves the adaptability of the track system 100 to fit the space in which the assembler is using with the track system 100. For example, the base supports 170 and the elongate support segments 160 can be used to control the length and angle of the raceway 105, bridge large gaps in the play area, and provide height to go over obstacles in the play area. In some implementations, the elongate support segments 160 can be readily modified by the assembler to fit into particular locations (e.g., the length of the elongate support segments 160 can be shorten by cutting).

Figure 2:
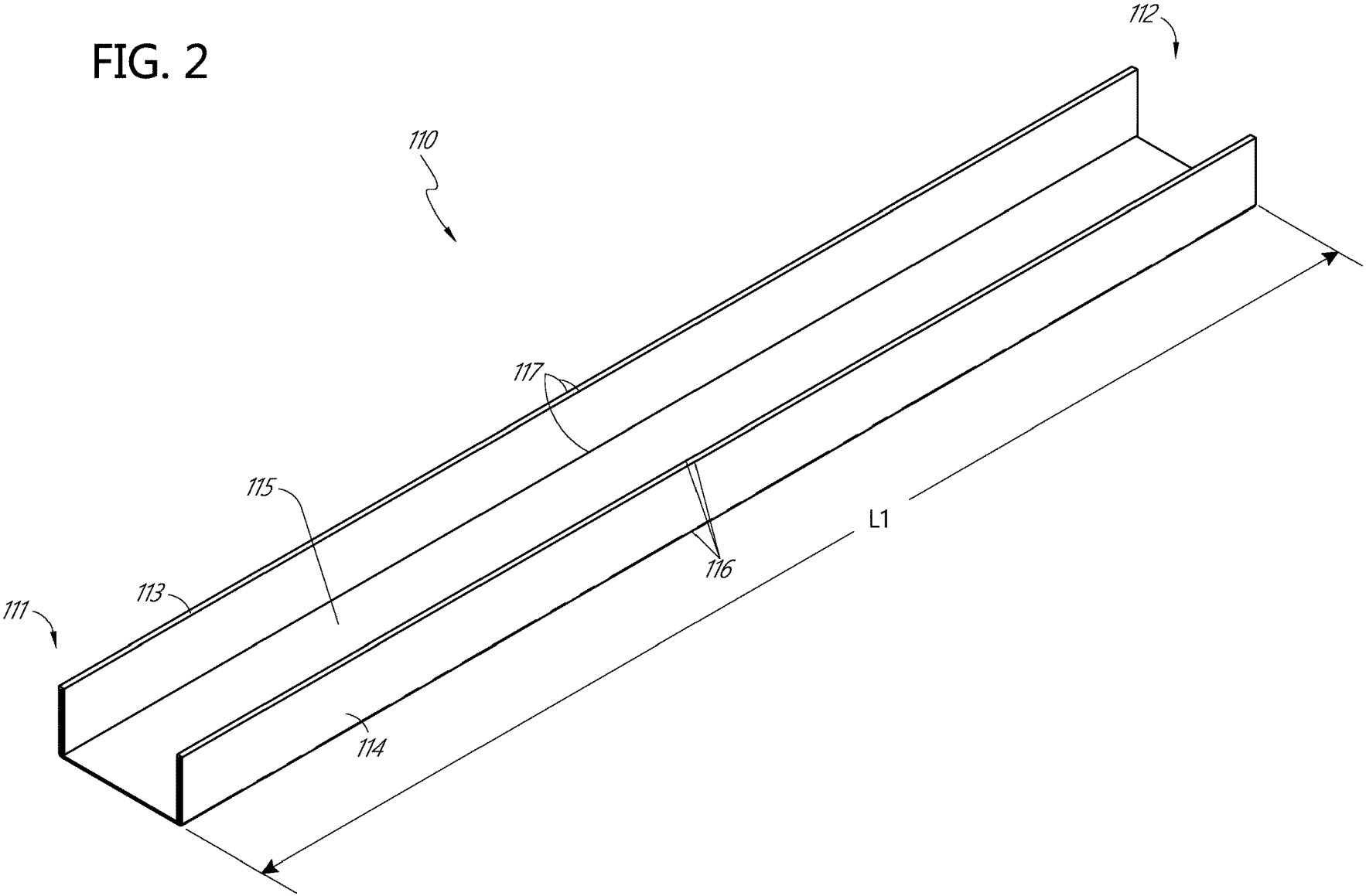
FIG. 2 illustrates a perspective view of a straight track segment.

Referring to FIGS. 2-4, the exemplary straight track segment 110 can include a first end 111 and a second end 112. Between the first and second ends 111, 112, the straight track segment 110 can include a generally U-shaped channel. The U-shaped channel can include a first upright side 113 and a second upright side 114. A base 115 can connect the first and second upright sides 113, 114. The first and second upright sides 113, 114 together with the base 115 can form the generally U-shaped channel.

In certain implementations, the first upright side 113 can include one or more fold lines 117. Similarly, the second upright side 114 can be defined by one or more fold lines 116. For example, the first and second upright sides 113, 114 can couple with the base 115 at fold lines of the one or more fold lines 116, 117, respectively.

Figure 4A:
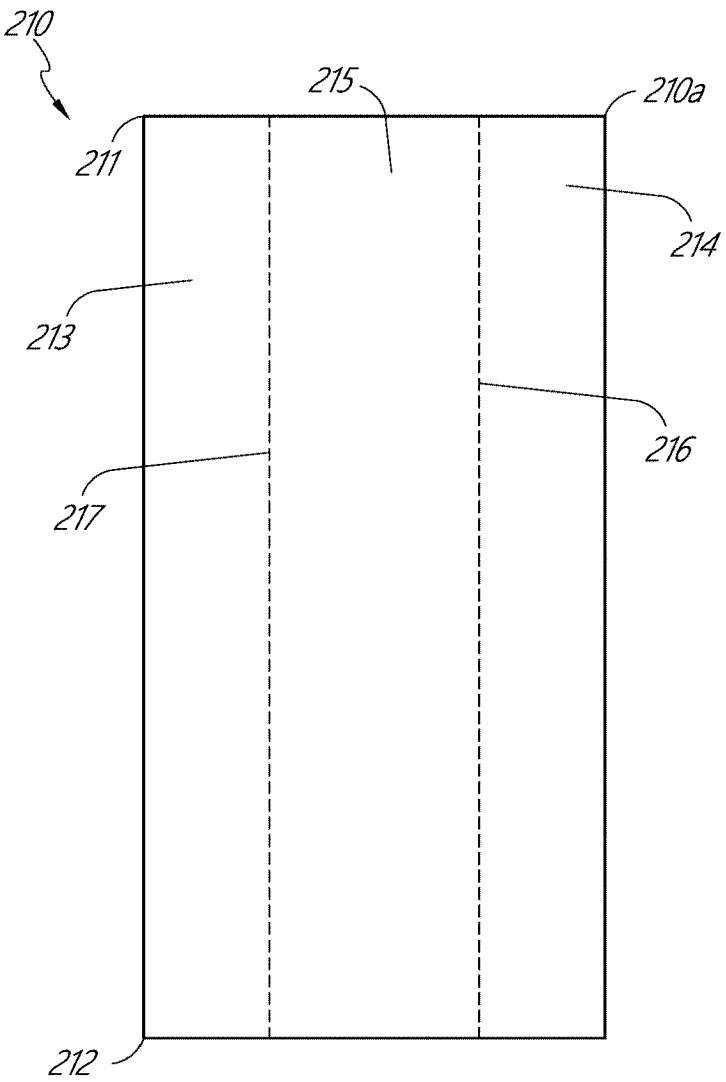
FIG. 4A illustrates a plan view of a paperboard.
Figure 3A:
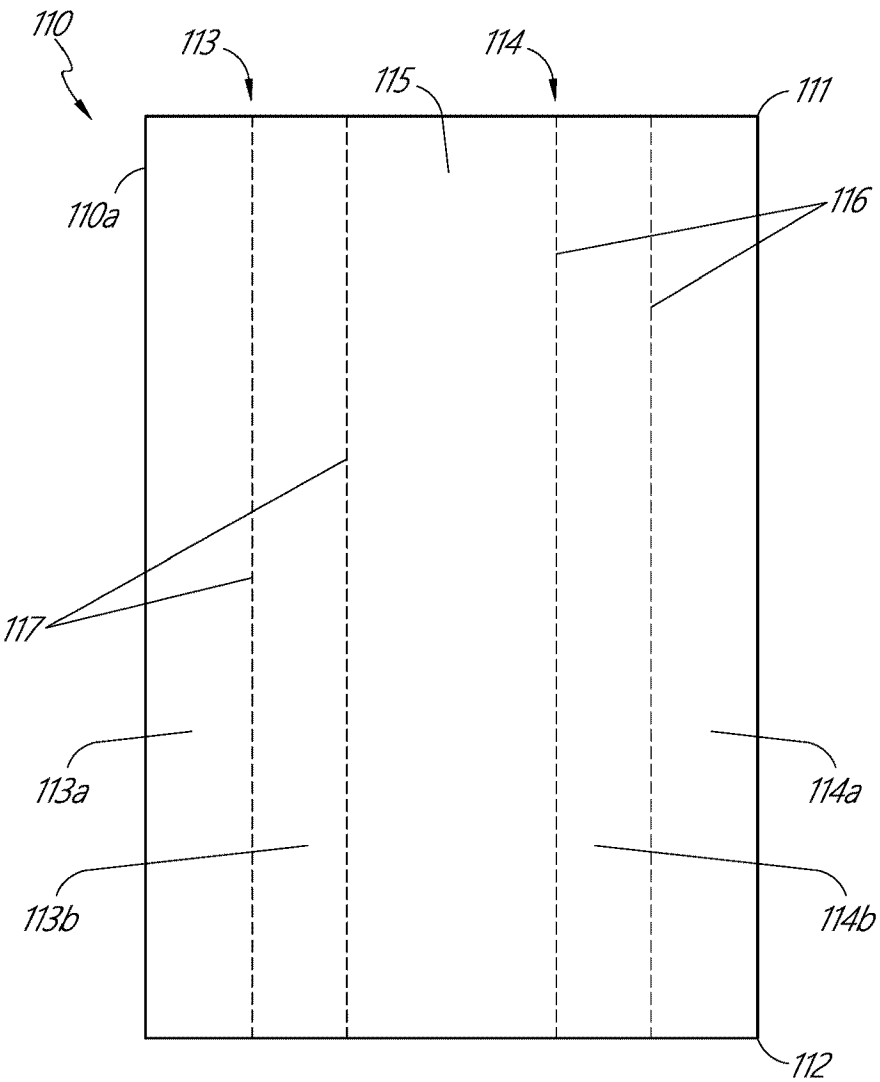
FIG. 3A illustrates a plan view of a paperboard.

As illustrated in FIGS. 3A and 4A, the straight track segment 110 can be formed of a flat sheet 110*a*. The sheet 110*a* can be formed of a paper, cardboard, paperboard, recycled fiber or other fibrous pulp material (generically referred to as paperboard). This material type can be low cost and require minimal manufacturing, processing and packaging, which can keep the cost of the overall kit or track system 100 down. Moreover, the sheet material can be constructed of an ecologically friendly material (e.g., paper or cardboard), which can be recycled, thereby reducing landfill waste.

The sheet 110*a* can include the one or more fold lines 116 and 117 as preformed fold lines within the surface of the sheet 110*a* (e.g., the fold lines 116, 117 can be pressed or rolled into the sheet 110*a*). The fold lines 116, 117 can be located to form the first and second upright sides 113, 114. In the illustrated embodiment of FIG. 3A (as further shown in FIG. 3B), the first upright side 113 is formed by folding the sheet 110*a* along the fold lines 117. The fold lines 117 can form an inner panel 113*a* and an outer panel 113*b* of the upright side 113. In some implementations, additional fold lines and/or panel portions can be included (e.g., a top lateral portion between the inner and outer panels 113*a-b*). Similarly, the second upright side 114 can include an inside panel 114*a* and an outside panel 114*b* divided by the one or more fold lines 116. In some implementations, the fold lines 116, 117 can be preformed perforated lines to facilitate the folding of the sheet 100*a* along the fold lines 116, 117.

Figure 4B:
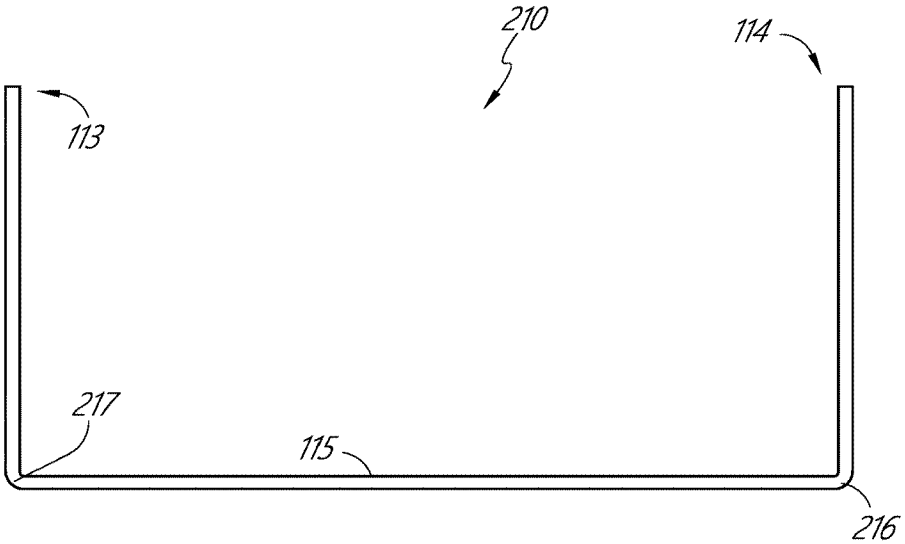
FIG. 4B illustrates an end view of the paperboard material of FIG. 4A folded into the straight track segment of FIG. 2.

In some implementations, one or more second straight track segments 210 is provided, as illustrated in FIGS. 4A-B. The second straight track segment 210 can be formed of a sheet 210*a* with two preformed fold lines 216, 217 to define a first upright side 213, a second upright side 214 and a base 215 connecting the first and second upright sides 213, 214 in a generally U-shaped channel. Similar to the straight track segment 110, the second straight track segment 210 can include a first end 211 and a second end 212. When assembled, the second straight track segment 210 can form a generally U-shaped channel.

In some implementations of the kit containing the component parts of the track system 100, the straight track segments 110/210 can be packaged in the form of the flat sheets 110*a*, 210*a*. By folding along the one or more fold lines (e.g., perforated lines) 116-117, 216-217, the generally U-shaped channels of the straight track segments 110/210 can be formed by the assembler. This configuration can allow for the straight track type components of the kit to be easily packaged can stored. For example, the kit can include a compact stack of many flat sheets 110*a* that can each be turned into the straight track segments 110. Moreover, the flat sheets 110*a* can be easily manufactured by a simple cutting and rolling process to form the overall shape and folds lines 116, 117.

Figure 3B:
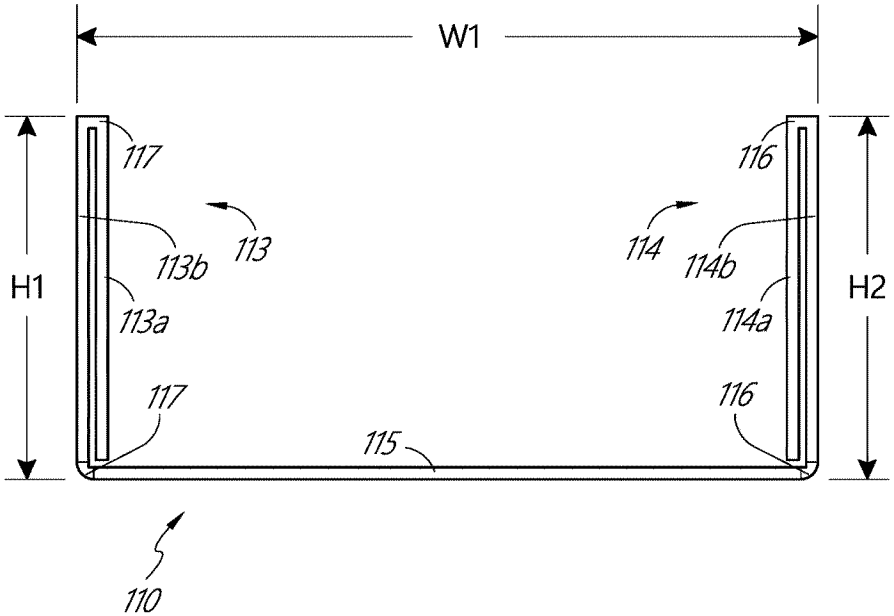
FIG. 3B illustrates an end view of the paperboard material of FIG. 3A folded into the straight track segment of FIG. 2.

As illustrated in FIG. 3B, the straight track segment 110 can have a width W1 that accommodates a toy car or truck (e.g. a HOT WHEELS® car or a MATCHBOX® car) on the base 115. In some implementations, the width W1 can be between approximately 1.0 inch and 3.0 inches (+/−0.5 inches). In other implementations the width can be less than or more than these numbers.

Similarly, the first upright side 113 can have a height H1 and the second upright side 114 can have height H2. In some implementations, the first and second heights H1, H2 can be substantially equivalent. In other implementations, the first and second heights H1, H2 are unequal. The heights H1, H2 of the first and second upright sides 113, 114 can be sized to prevent the toy car from careening off of or outside of the channel of the straight track segment 110 (e.g., off of the raceway 105). In some implementations, either or both of the heights H1, H2 can be between about ⅜ inches to 1.5 inches. In other implementations the heights can be less than or greater than these numbers.

In some implementations, the overall length L1 of the straight track segment 110 can be between about 2.0 inches and 3.0 feet or more. The maximum length of L1 can be limited, in some implementations, only by the stiffness of the paperboard material to maintain the shape of the straight track segment, especially under usage conditions (e.g., children playing with toy cars on the track segments). In some implementations of the straight track segment 110, the straight track segment 110 can be approximately 1.0 to 3.0 feet. In other implementations, an exceptionally long (e.g., 3.0 feet or more) straight track segment 110 can be included. Optionally, instructions to cut down the long straight track segment 110 according to the needs and desired configuration of the assembled track system 100 can be included in the kit.

Figure 5:
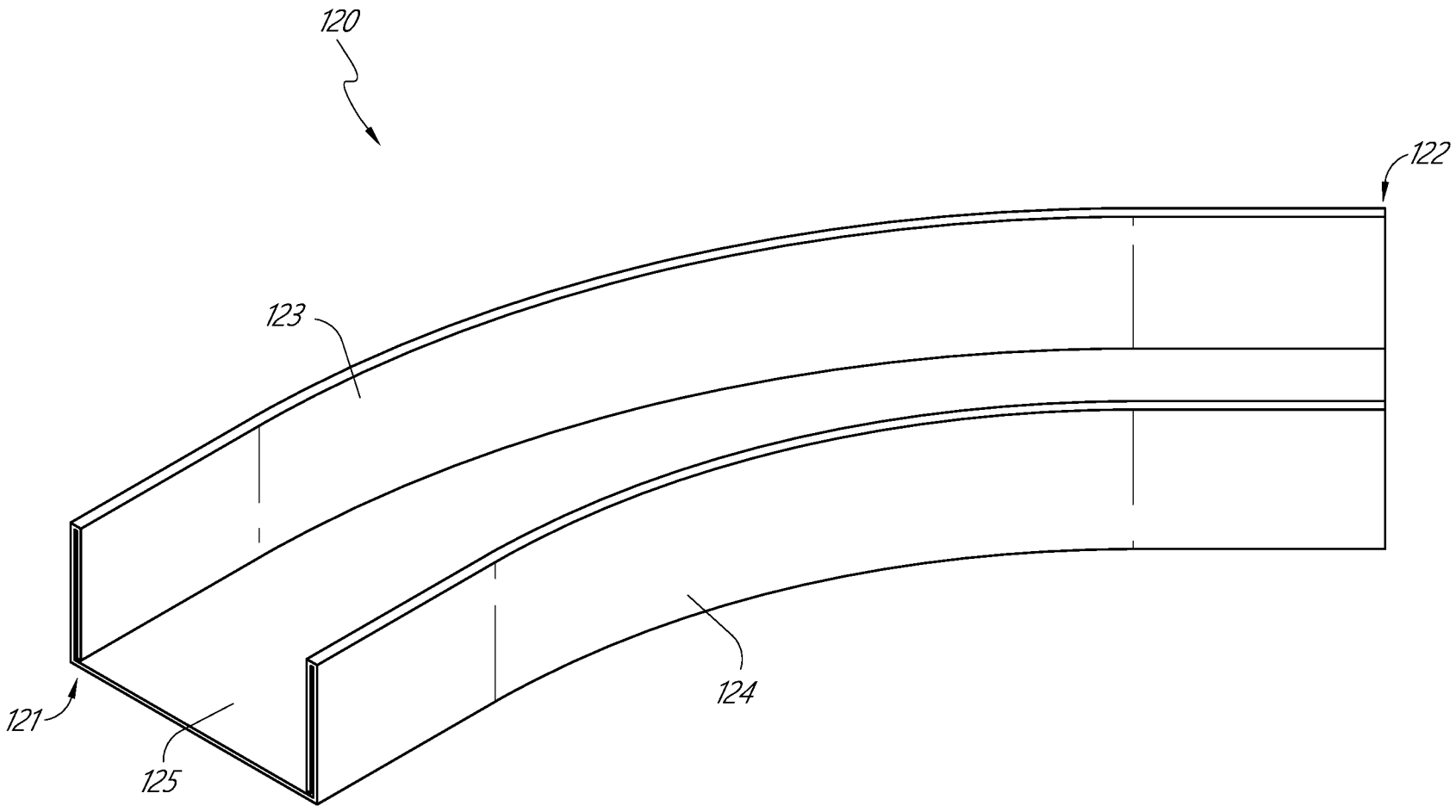
FIG. 5 illustrates a perspective view of a curved track segment.
Figure 6A:
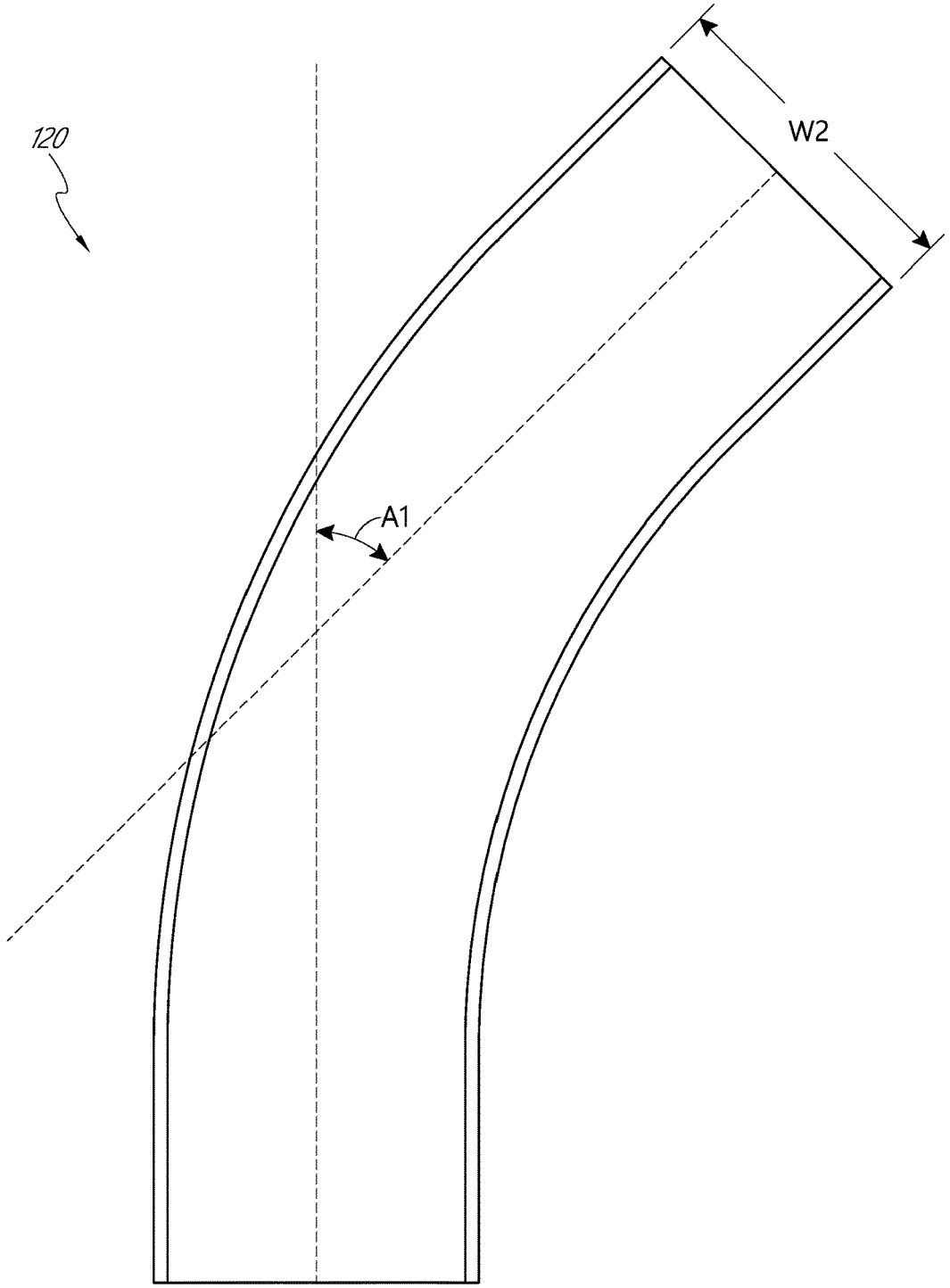
FIG. 6A illustrates a top view of the curved track segment of FIG. 5.
Figure 7:
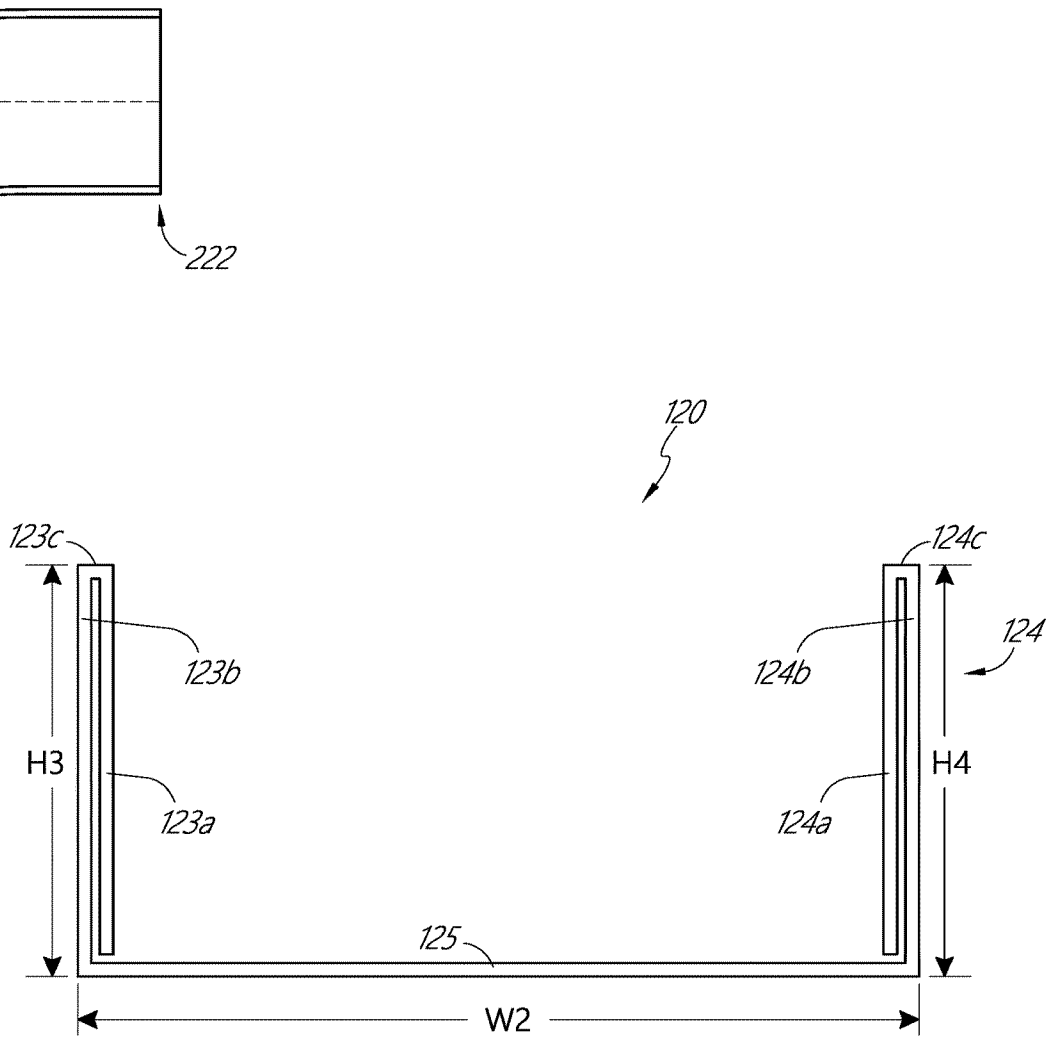
FIG. 7 illustrates an end view of the curved track segment of FIG. 5.

FIGS. 5-7 illustrate the curved track segment 120. The curved track segment 120 can form a generally U-shaped channel between a first end 121 and a second end 122. A first upright side 123 can be connected with a second upright side 124 by a base 125. While having a U-shaped cross section that is similar to the straight track segment 110, the curved track segment 120 is generally not formed of a folded sheet of paperboard. Instead, the curved track segment 120 is formed of a molded plastic or thermo-formed fiber pulp (e.g., pressed and/or heated paper pulp) into the desired shape. These materials are readily available and generally cost-efficient to form into the desired shape.

Figure 6B:
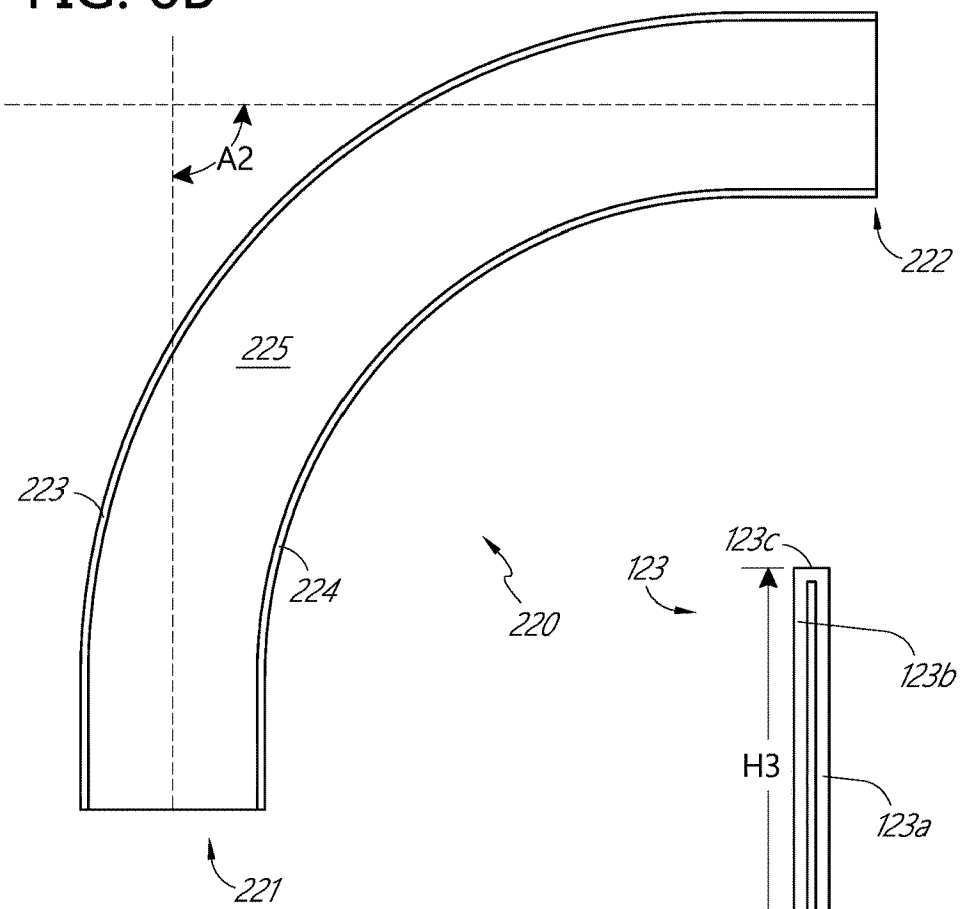
FIG. 6B illustrates a 90-degree curved track segment.

The curved track segment 120 at the first and/or second ends 121, 122 can have first and second upright sides 123, 124 that are generally straight and parallel with each other. Between the first and second ends 121, 122, the generally U-shaped channel transitions (e.g., curves) such that an angle A1 is created between the generally straight and parallel sections of the first and second ends 121, 122. In some implementations, as shown in FIG. 6*a*, the angle A1 can be approximately 45 degrees. In other implementations, the angle A1 can be between 0 and 90 degrees. As illustrated in FIG. 6*b*, the curved track segment 220 can have an angle A2 of approximately 90 degrees (e.g., forming a right angle). FIG. 6*b* illustrates a second curved track segment 220 having a first end 221, a second end 222, first and second upright sides 223, 224 and a base 225 connecting the first and second upright sides 223, 224.

As shown in FIG. 7, the first and second ends 121, 122 can have generally the same profile as the first and second ends 111, 112 of the straight track segment 110 (or straight track segment 210). The first and/or second ends 121, 122 can have a width W2. The width W2 can be substantially equivalent to the width W1 of the straight track segment 110. Similarly, the first upright side 123 can have a height H3 that is substantially equivalent to the height H1 of the first upright side 113 of the straight track segment 110. The second upright side 124 can have a height H4 substantially equivalent to the height H2 of the second upright side 114 of the straight track segment 110. In this manner the first and second ends 121, 122 (and the first and second ends 111, 112) can be coupled within the one or more track connectors 130, as described below.

In some implementations, the first and/or second upright sides 123, 124 can have inner panels (e.g. panels 123*a* and 124*a*) and outer panels (e.g. panels 123*b*, 124*b*). Each of inner and outer panels can be coupled together by an upper ridge (123*c*, 124*c*). The overall width of each of the first and second upright sides 123, 124 and/or compliance between the inner and outer panels can help to ensure that the curved track segment 120 stays coupled within the connector 130 (e.g., with first and second slots 133*b*, 134*b*, as described below).

The straight track segments 110 and the curved track segments 120 can be coupled together or coupled with other straight or curved track segments 110, 120 in any combination by the connectors 130 to form the raceway 105.

Figure 8:
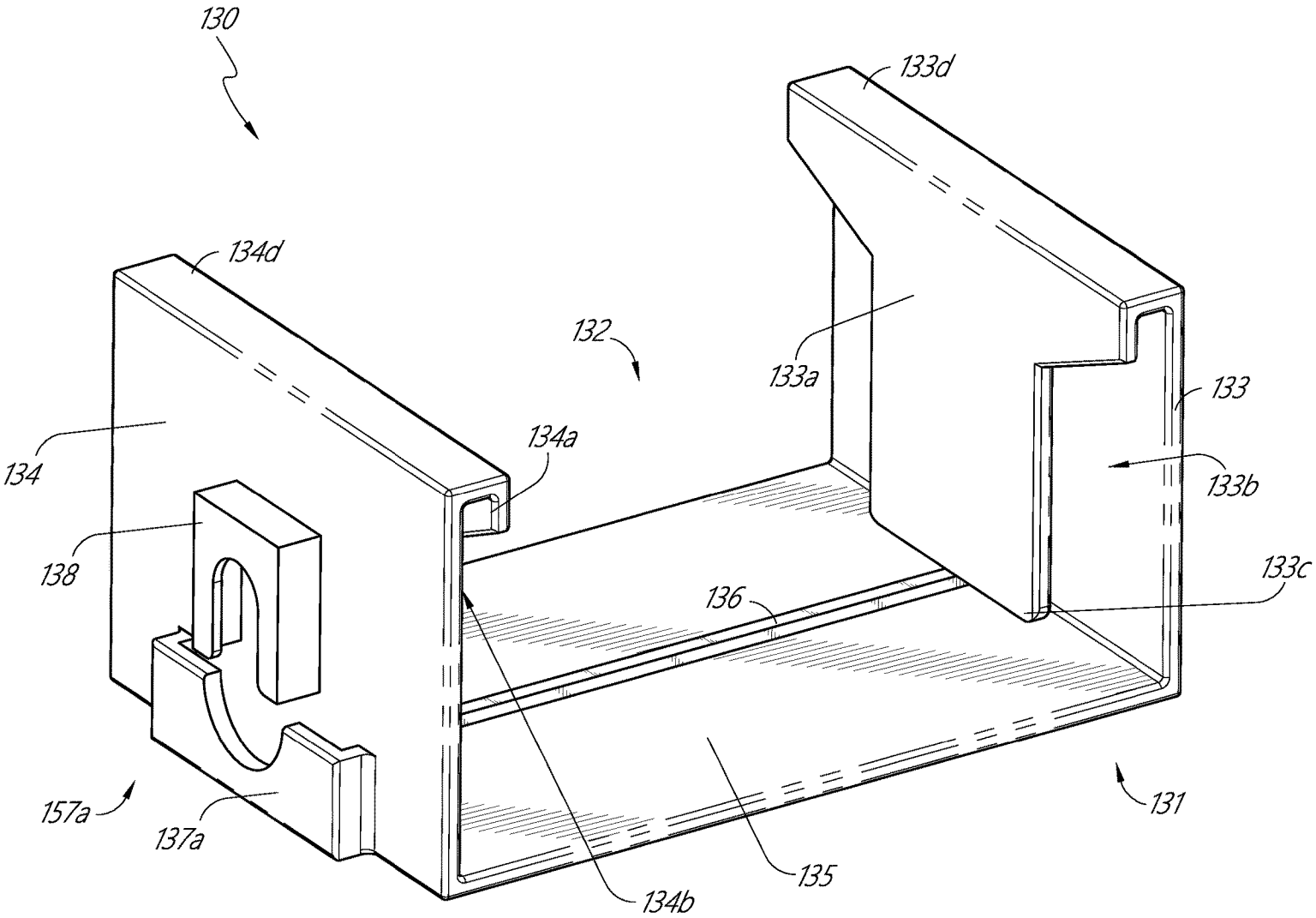
FIG. 8 illustrates a perspective view of a track connector.
Figure 9A:
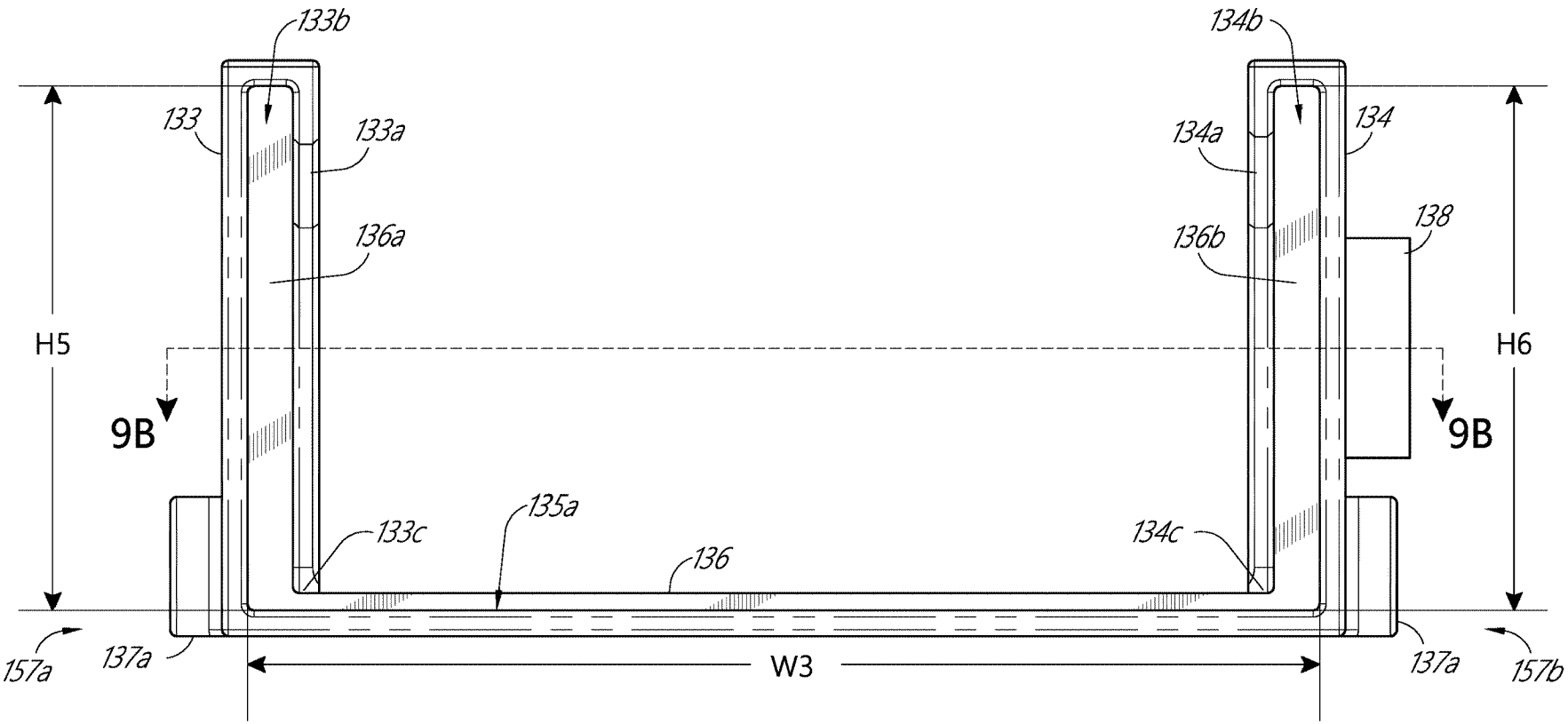
FIG. 9A illustrates an end view of the track connector of FIG. 8.
Figure 9B:
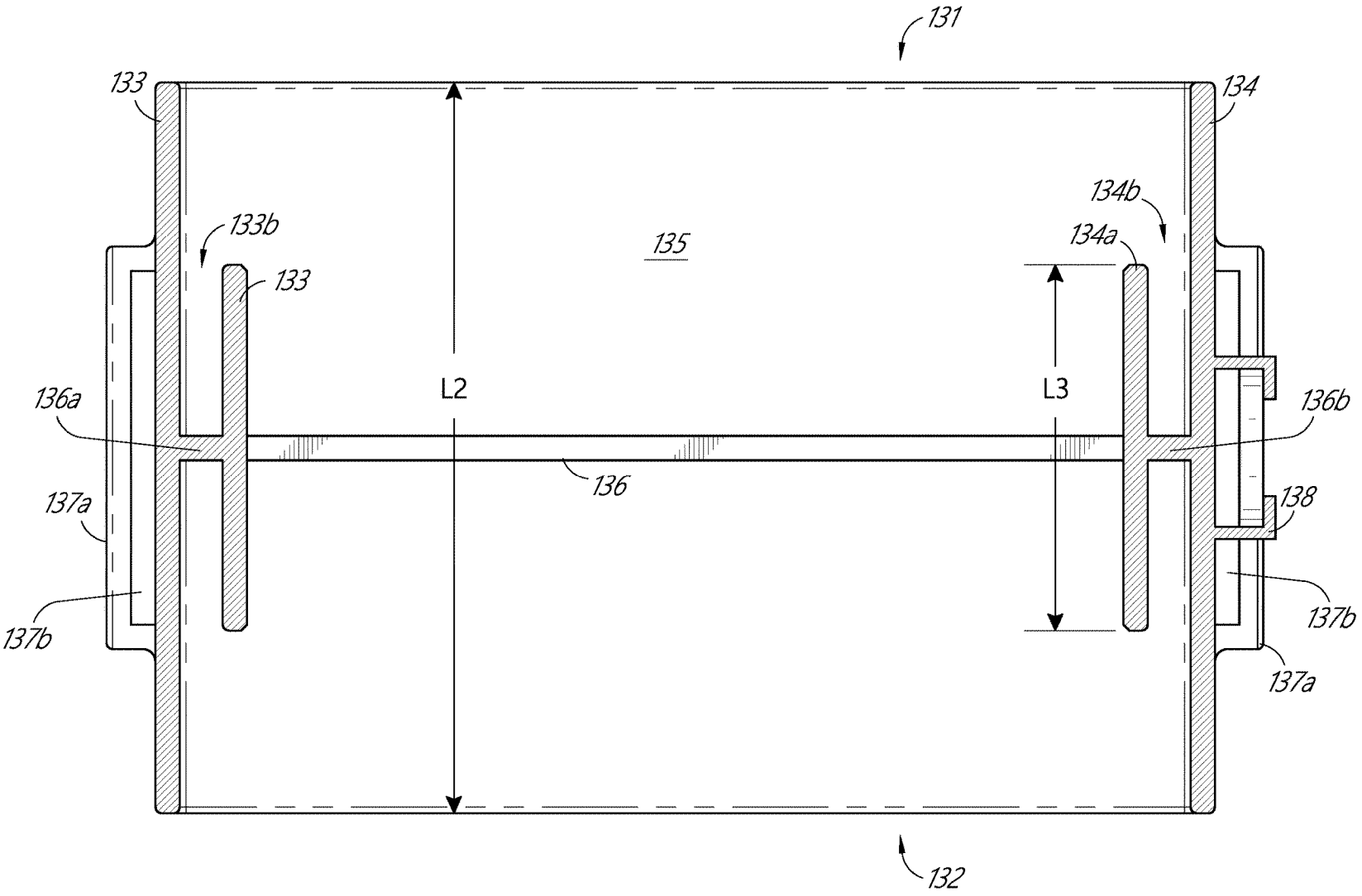
FIG. 9B illustrates a section view taken along the line 9B-9B in FIG. 9A.

FIGS. 8 and 9 illustrate the connector 130. In some implementations, the connector 130 can form a generally U-shaped channel. The U-shaped channel can be formed by a left wall 133, a base wall 135 and a right wall 134. The left wall 133 can include a first wing 133*a* forming a first slot 133*b* (e.g., between the first wing 133*a* and the left wall 133). The right wall 134 can include a second wing 134*a* forming a second slot 134*b* with the right wall 134 (e.g., between the second wing 134*a* and the right wall 134). The second wing 134*a* can optionally be a flat panel that is generally parallel with and spaced from the right wall 134. The first slot 133*b* can generally be at least partially bounded by generally parallel interior surfaces of the left wall 133 and the first wing 133*a*. In some implementations, the first wing 133*a* can be coupled with the left wall 133 by a lateral portion 133*d*. An end 133*c* of the first wing 133*a* can be spaced above an upper surface 135*a* from the base wall 135 (e.g., to accommodate the base 115 or base 125 of the track segments 110, 120). The second wing 134*a* can optionally be a flat panel that is generally parallel with and spaced from the right wall 134. The second slot 134*b* can generally be at least partially bounded by generally parallel interior surfaces of the right wall 134 and the second wing 134*a*. In some implementations the second wing 134*a* can be coupled with a lateral portion 134*d* coupled with the right wall 134. An end 134*c* of the second wing 134*a* can be spaced above the upper surface 135*a* of the base wall 135.

The connector 130 (e.g., the first and second slots 133*b*, 134*b*) can form first and second opposite receiving ends 131, 132 of the connector 130. The first and second opposite receiving ends 131, 132 can each receive (e.g., within the first and second slots 133*b*, 134*b*) one of two track segments (e.g., track segments 110 and/or 120). For example, the connector 130 can receive on the opposite receiving ends 131, 132 the ends of the straight track segments 110 or the curved track segments 120 in any combination (e.g. two straight track segments 110, one straight track segment 110 and one curved track segment 120, or two curved track segments 120). The first receiving end 131 can at least partially receive the end of one of the two track segments and the second receiving end 132 can at least partially receive an end of the second track segment to thereby form the continuous raceway 105 from one track segment to the second track segment.

The connector 130 can generally have a width W3 corresponding or equivalent to the widths W1 of the straight track segment 110 and/or the width W2 of the curved track segment 120. Specifically, the width W3 of the track connector 130 can be measured between inner surfaces of the slots 133*b*, 134*b* (e.g., sized to fit within the first and second slots 133*b*, 134*b*). The first slot 133*b* can have a height H5 (and the second slot 134*b* can have a height H6) corresponding or equivalent to the heights of the upright sides of the straight track segment 110 and/or the curved segment 120 (e.g., upright sides 113, 114, 123, 124 with corresponding heights H1, H2, H3, H4). The heights H5, H6 can be measured from the upper surface 135*a* of the base wall 135 to the uppermost interior portion of the slots 133*b*, 134*b*, respectively (e.g., at lateral portions 133*d*, 134*d*).

The first slot 133*b* (e.g., on the first receiving end 131) can receive a first upright side of the first track segment and the second slot 134*b* (e.g., on the first receiving end 131) can receive a second upright side of the first track segment. Similarly, the first slot 133*b* (e.g., on the second receiving end 132) can receive a first upright side of the second track segment and the second slot 134*b* (e.g., on the second receiving end 132) can receive a second upright side of the second track segment. Furthermore, the track connector 130 (e.g., the first and second slots 133*b*, 134*b*) can provide rigidity and structural stability to the track segments. For example, the straight track segments 110 that are formed of the flat sheet 110*a* and folded into the generally U-shaped channel can be generally held with the first and second uprights sides in an upright position (e.g., 90 degrees) with respect to the base 115 by the connector 130.

The bases of the track segments (e.g. the base 115 or base 125) when assembled with the connector 130 can contact the upper surface 135*a* of the base wall 135. In some implementations, the base wall 135 can include a central ridge 136. The ridge 136 can be formed along a center of the base wall 135. The ridge 136 can be either continuous or segmented. The ridge 136 can be parallel to edges of the base wall 135 and/or perpendicular with one or both of the left and right walls 133, 134. When the connector 130 is assembled together with a track segment, the end of the track segment can be aligned with the ridge 136. This can aid the assembler in assembly of the track segment with the connector 130 by helping the assembler to know when the track segment is fully inserted into the connector 130. In some implementations, one or both of the first and second slots 133*b*, 134*b* can include vertical ridges 136*a*, 136*b*. The vertical ridges 136*a* and/or 136*b* can be aligned with the ridge 136.

The connector 130 and in particular the slots 133*b*, 134*b* and/or the base wall 135 can have a length L2. In some implementations, length L2 can be between 0.5" and 3.0" inches. In some implementations, the depth of the slots 133*b*, 134*b* can correspond to the length L2. The ridge 136 can be located at the midpoint of the length L2.

The base (e.g., bases 115, 125) of the track segments assembled with the connector 130 can be fit between the lower ends 133*c*, 134*c* of the first and second wings 133*a*, 134*a*. The lower ends 133*c*, 134*c* can contact the base to help secure the track segment within the connector 130.

Either or both of the left or right walls 133, 134 (or the base wall 135) can include a mounting coupler 138. The mounting coupler 138 can couple with a mounting mechanism such as a magnet, suction cup or other mounting mechanism discussed further below. In some implementations, the mounting coupler 138 can include a slot for receiving and securely mounting a flange of the mounting mechanism.

Either or both of the left or right walls 133, 134 (or the base wall 135) can include a securing clip 157 (e.g., clips 157*a*, 157*b*) for securing (e.g., mechanically attaching) the interchangeable support 150 with the connector 130. The clip 157*a* can include a first coupling component (e.g., a slot 137*a*) on the connector 130 and a second coupling component (e.g., a tapered member 159*a*) on the interchangeable support 150. The first and second coupling components can be paired with mechanical clips of various sorts, such as but not limited to, those described and illustrated below (e.g., a slot 137*a* and tapered member 159*a* received within the slot).

The connector 130 can be formed of a molded plastic, thermo-formed fiber pulp, or similar. Preferably, the connector 130 can be made from a recycled plastic that is cheap and easily manufactured using readily available techniques.

Figure 10:
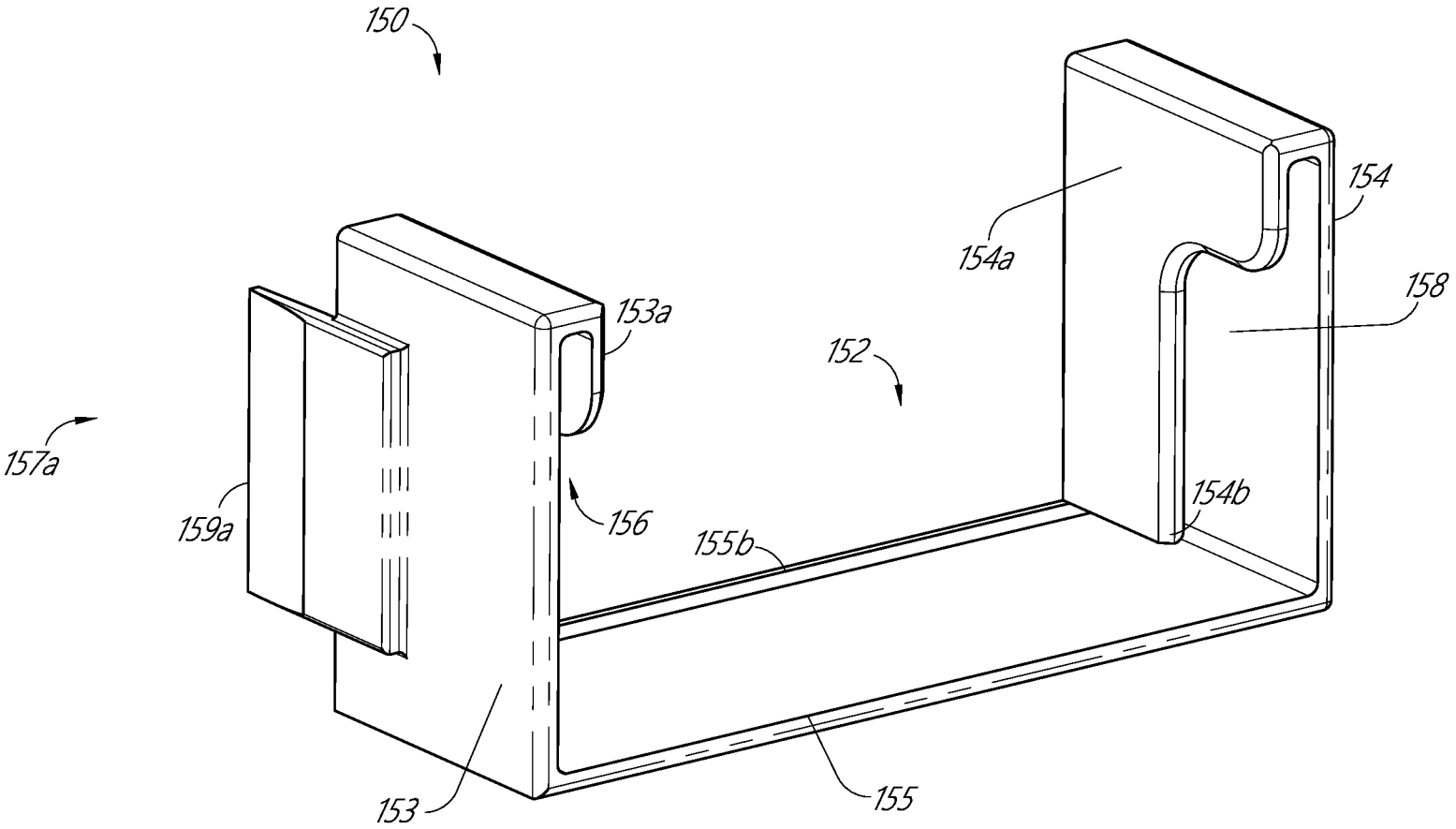
FIG. 10 illustrates top perspective view of a support.
Figure 11:
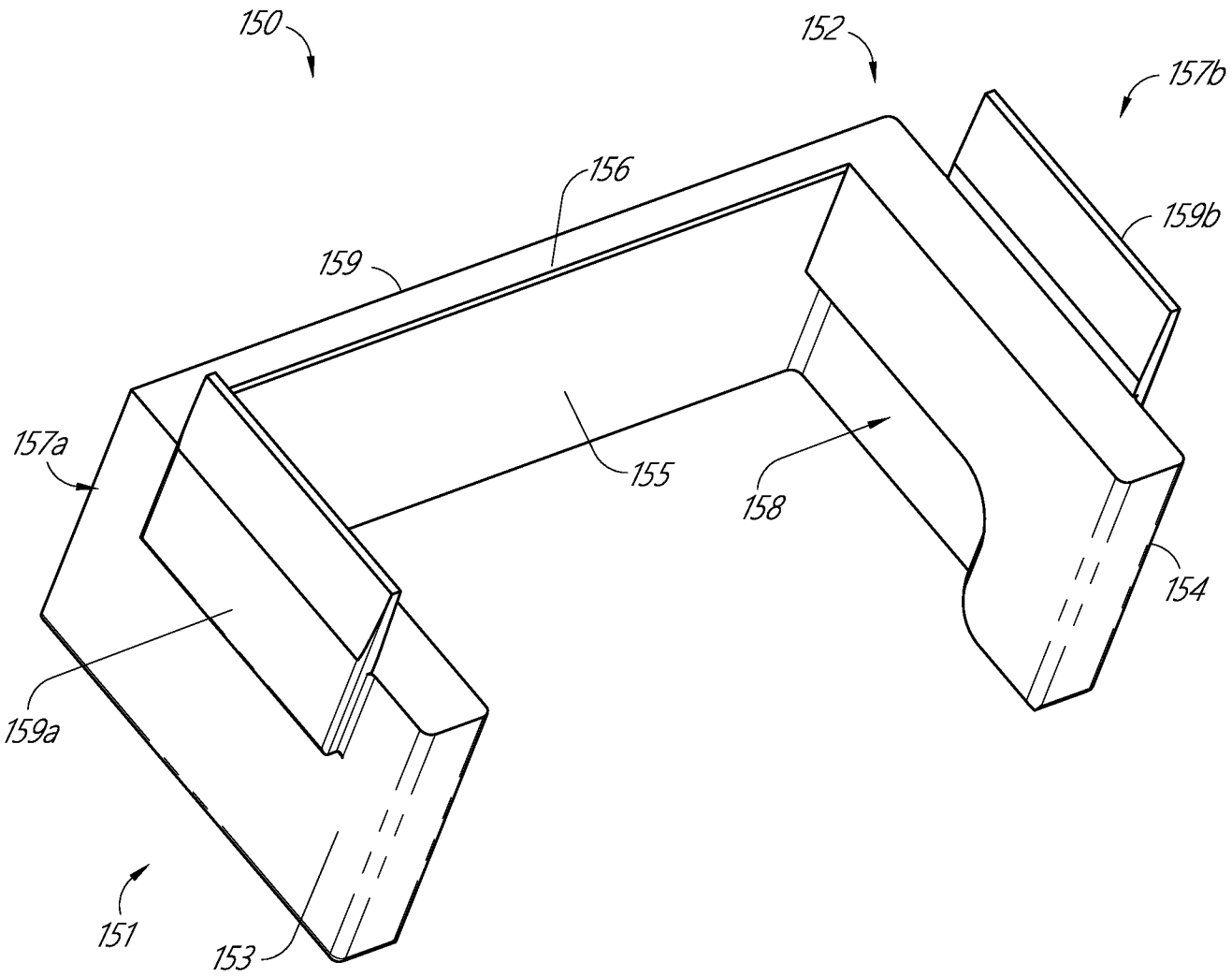
FIG. 11 illustrates a bottom perspective view of the support of FIG. 10.
Figure 12A:
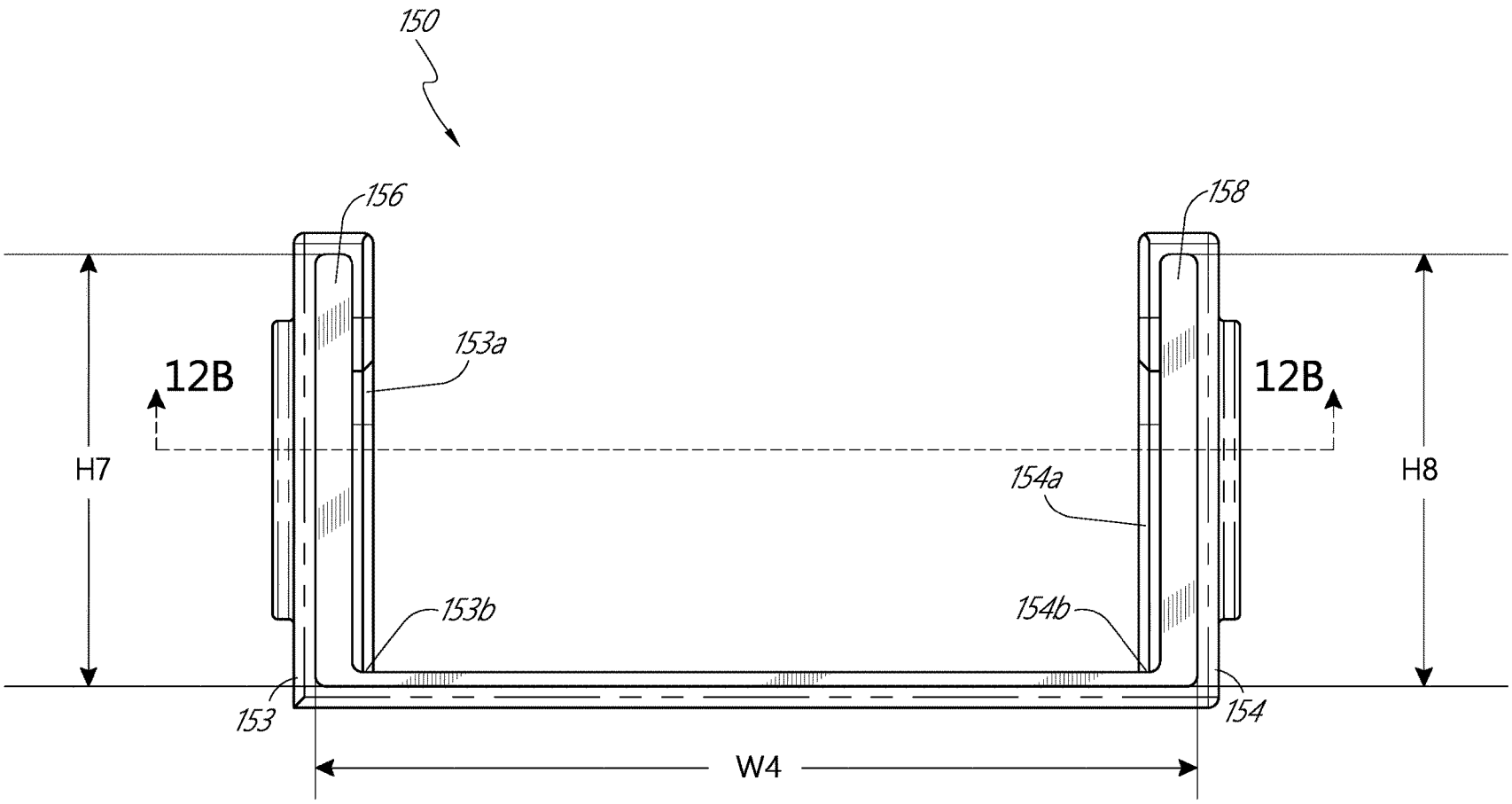
FIG. 12A illustrates an end view of the support of FIG. 10.
Figure 12B:
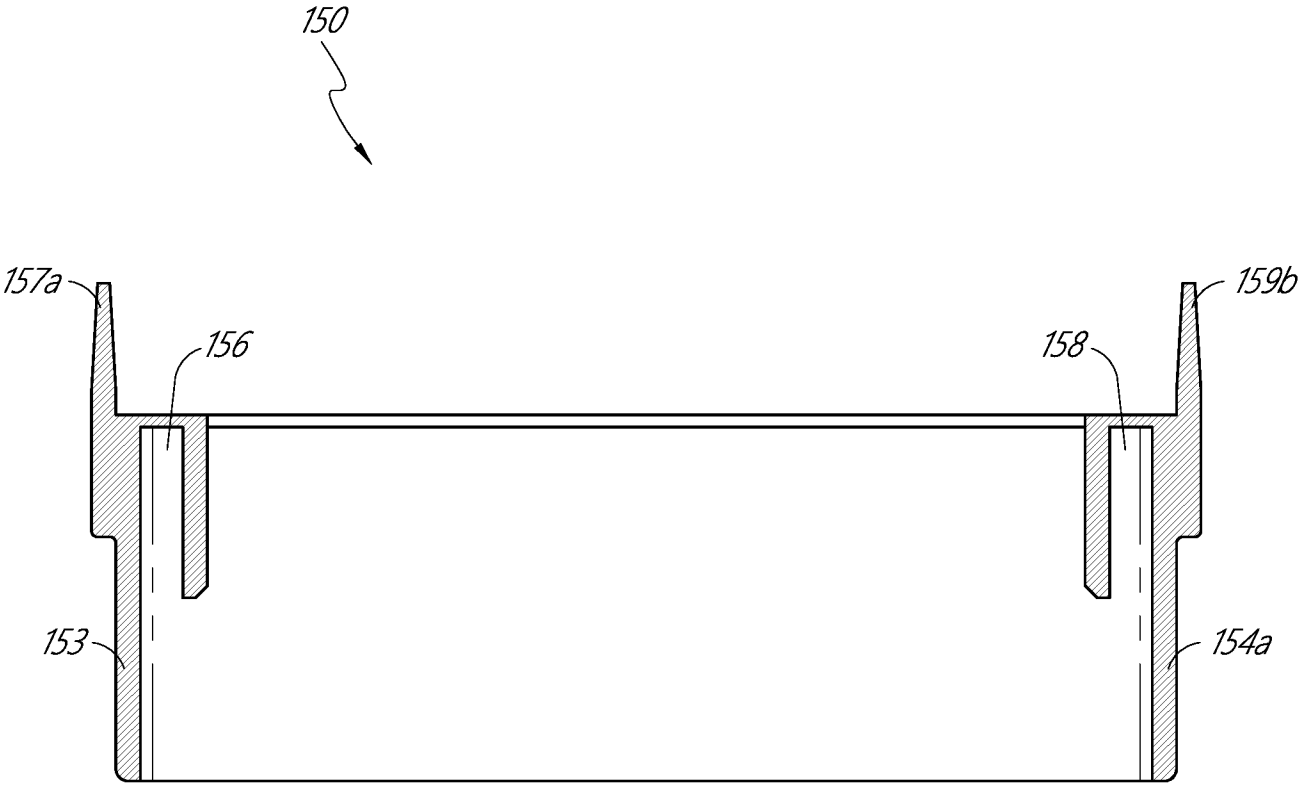
FIG. 12B illustrates a section view taken along the line 12B-12B in FIG. 12A.

FIGS. 10-12 illustrate the interchangeable support 150. The interchangeable support 150 can be clipped with the connector 130 to provide height and elevation to the raceway 105 of the track system 100. The interchangeable support 150 can include a left wall 153 and a right wall 154 coupled together with a base wall 155. The left wall 153 can include a first slot 156. The right wall 154 can include a second slot 158. The first slot 156 can be formed by a first wing portion 153*a*. The first wing portion 153*a* can extend substantially parallel to the left wall 153. The second slot 158 can be formed by a second wing portion 154*a*. The wing portion 154*a* can extend substantially parallel to the right wall 154. In some implementations, the interchangeable support 150 can be generally U-shaped with a generally U-shaped slot (e.g., the first and second slots 156, 158 can be coupled together).

The first tapered member 159*a* can extend from the left wall portion 153. The first tapered member 159*a* can be part of the clip 157*a* and securely couples with the slot 137*a* of the connector 130. Similarly, a second tapered member 159*b* can be part of the clip 157*b* and securely couples with the slot 137*b* of the connector 130. When clipped together, in some implementations, an upper surface 159*c* (e.g., shelf) of the interchangeable support 150 can be coupled with a bottom surface of the base wall 135 of the connector 130.

The first and second slots 156, 158 can receive the elongated support 160 to provide additional height to the raceway 105 and connector 130. An outermost end 153*b* of the first wing 153*a* can extend approximate the base wall 155 with a space positioned therebetween. This space between the lower ends 153*b*, 154*b* and the lower wall can receive a base of the elongate support 160 (e.g., base 115). First and second upright sides of the elongate support (e.g., upright sides 113, 114) can be received within the first and second slots 156, 158. A ridge 155*b* of the base wall 155 can ridge can limit the extent to which the elongate support 160 extends into the interchangeable support 150.

The interchangeable support 150 can have a width W4. The width W4 can correspond to the width of the other components of the track system 100. For example, the width W4 can correspond to the width W1 of the straight track segment 110, the width W2 of the curved track segment 120 or the width W3 of the connector 130. This is one of the ways that some of the implementations of the track system 100 can be made to be modular with all of the straight track segments 110 being usable as the elongate support 160.

The first slot 156 can have a height H7. This height H7 can correspond to the height of the left or upright sides 113 or 114 of the straight track segment 110. The second slot 158 can have a height H8. This height H8 can correspond to the height of the left or upright sides 113 or 114 of the straight track segment 110.

Figure 13A:
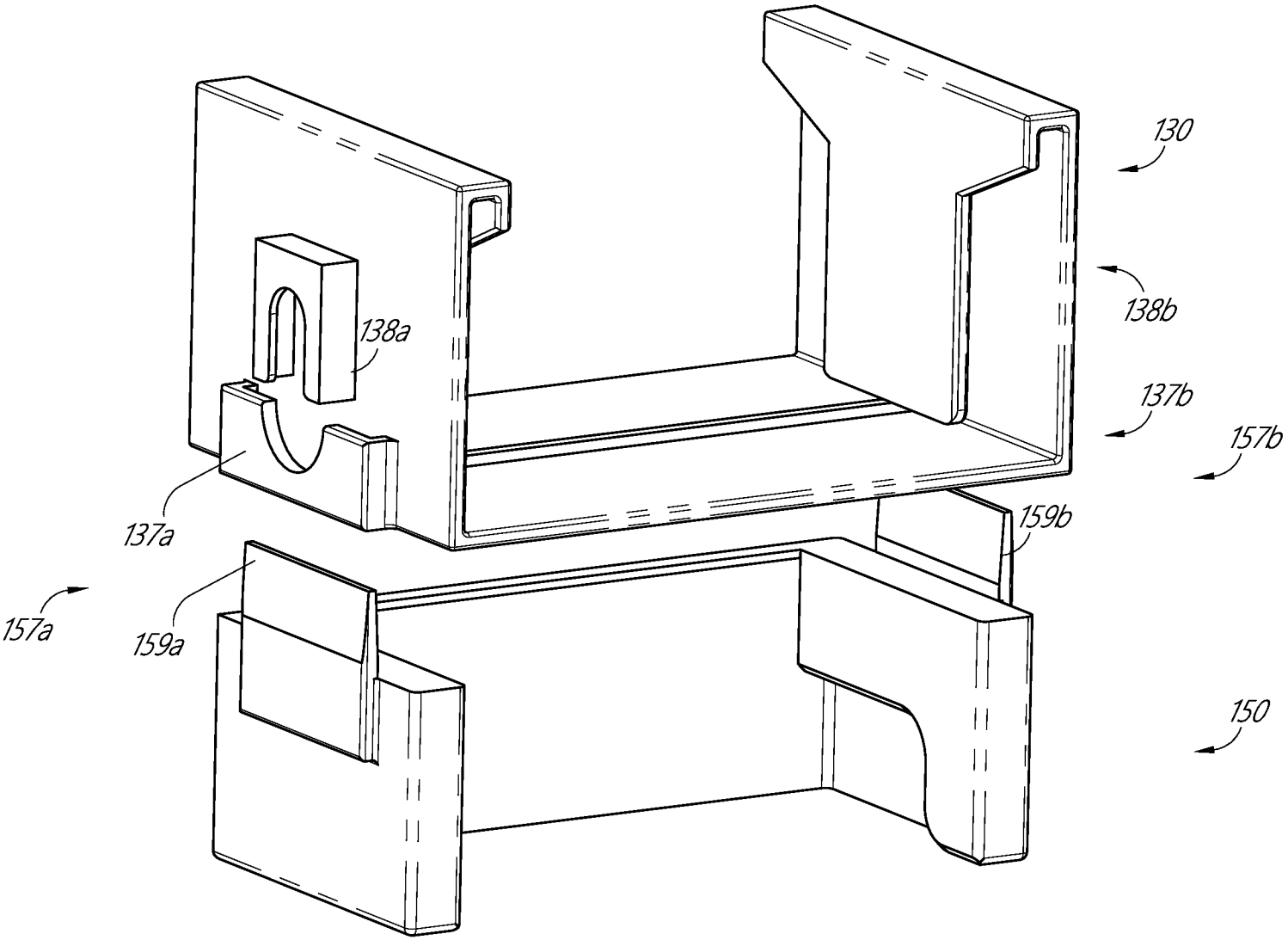
FIG. 13A illustrates an exploded perspective view of another securing clip.

As shown in FIG. 13, the connector 130 can be aligned and coupled with the interchangeable support 150 by the securing clip 157. For example, the first and second components (e.g., slot 137*a/b* and tapered member 159*a/b*) of the securing clips 157*a* and 157*b* can be aligned and clipped together through a translation motion.

Figure 13B:
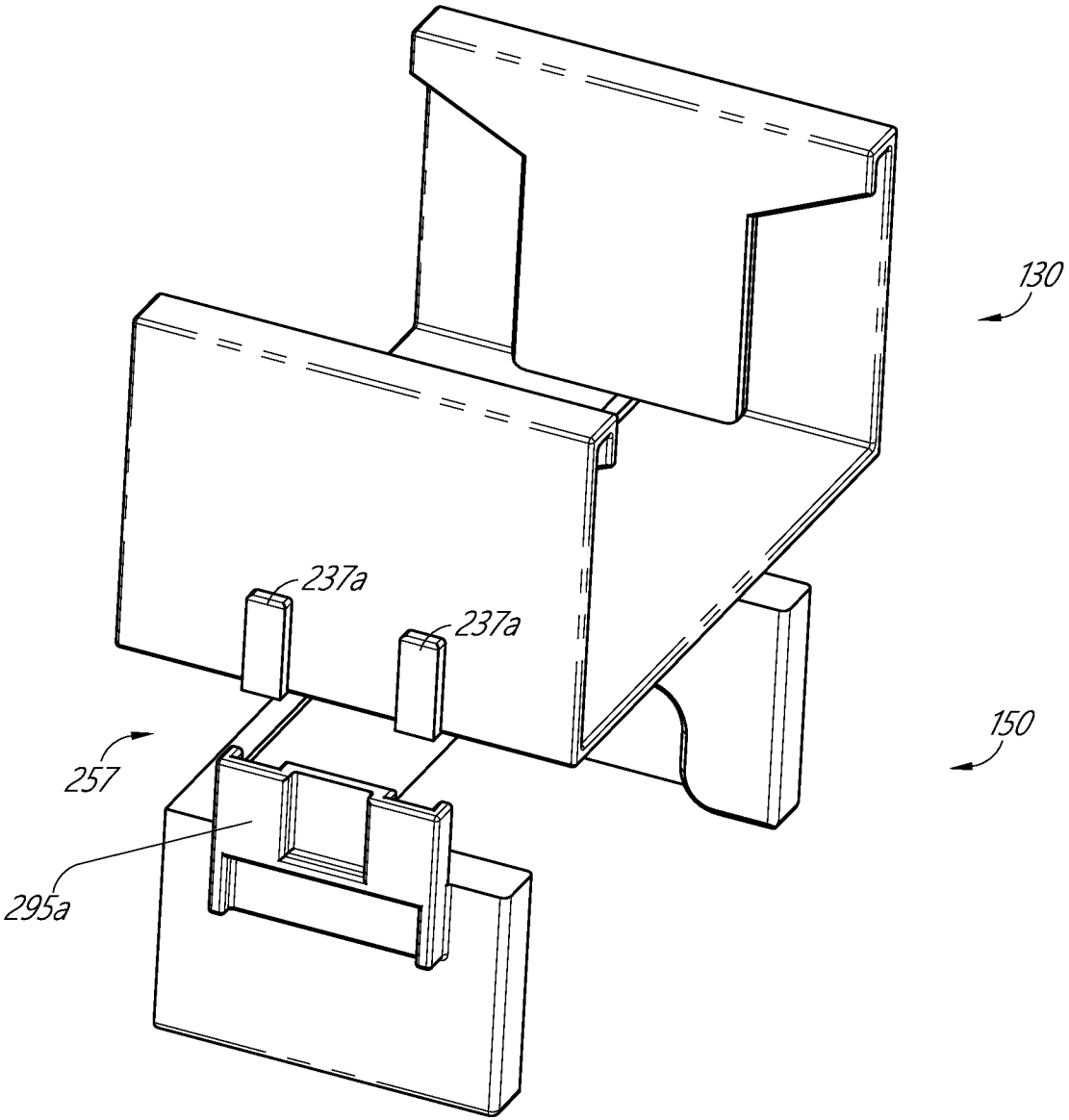
FIG. 13B illustrates an exploded perspective view of another securing clip.
Figure 13C:
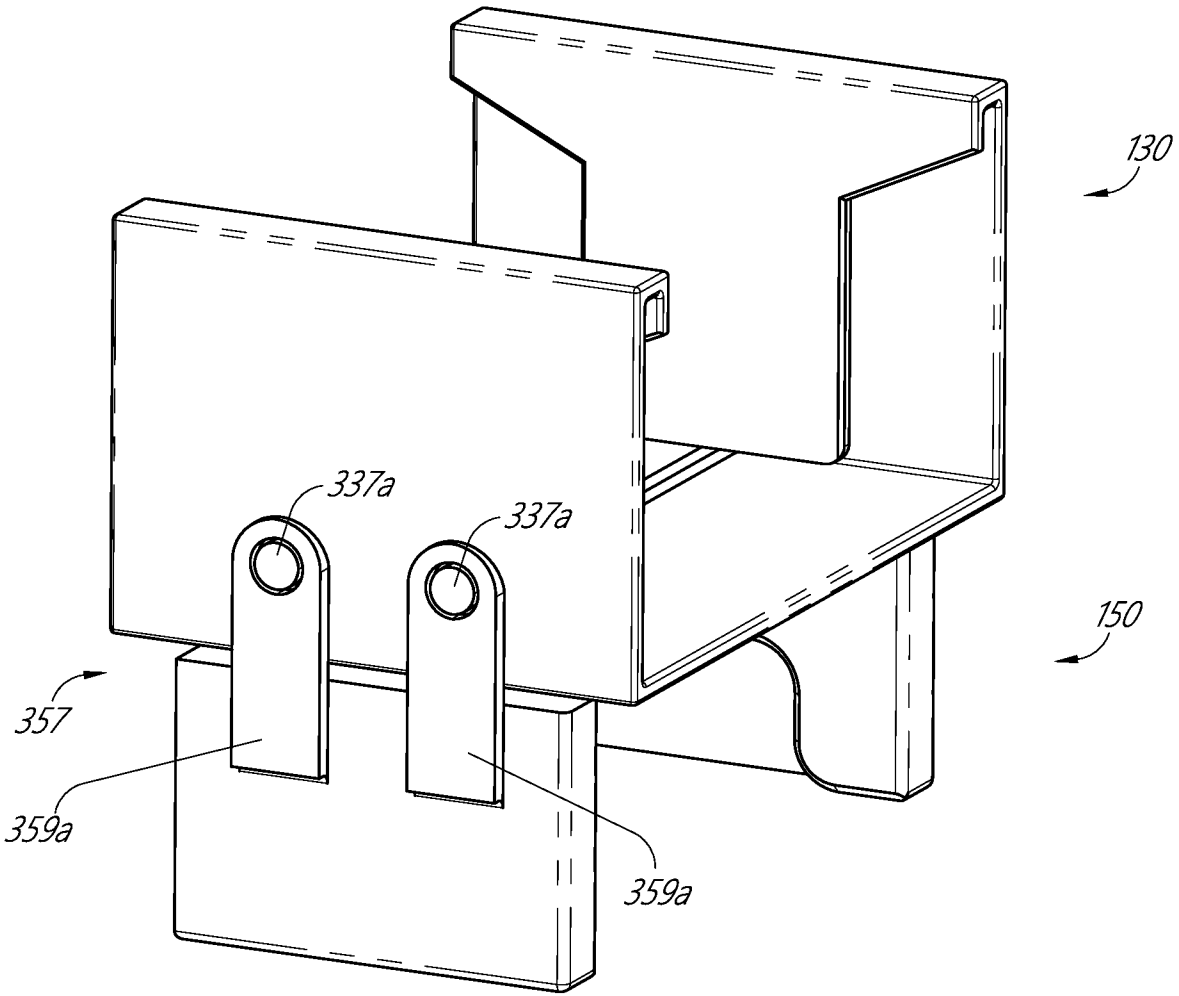
FIG. 13C illustrates an exploded perspective view of another securing clip.

FIGS. 13B and 13C illustrate securing clips 257, 357. The securing clip 257 can include one or more rib receiving slots 259*a* that correspond to and receive one or more ribs 237*a*. In other implementations, the ribs 237*a* can be on the interchangeable support 150 and the rib receiving slots 259*a* can be on the connector 130.

Similarly, the securing clip 357 can include one or more flexible eyelets 359*a* that can be coupled with or on one or more pegs 337*a*. In other implementations, the pegs 337*a* and the flexible eyelets 359*a* can be switched (e.g., reversed on the interchangeable support 150 and connector 130). In another implementation, the pegs 337*a* and the flexible eyelets 359*a* can be alternated across the interchangeable support 150 and connector 130 (e.g., two pegs 337*a* and two flexible eyelets 359*a* point in opposite directions).

Figure 14A:
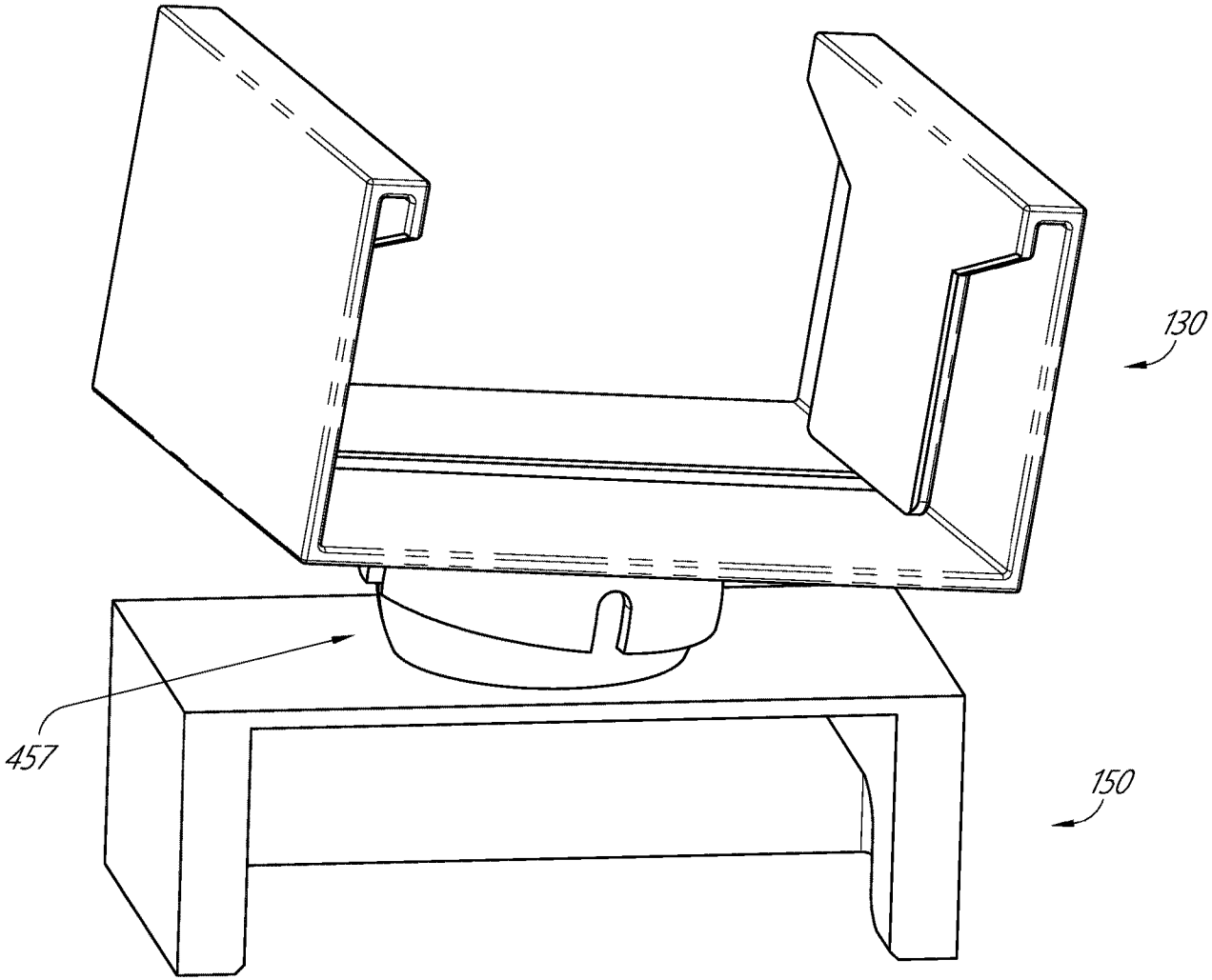
FIG. 14A illustrates a track connector coupled with a support by a ball and socket joint.
Figure 14B:
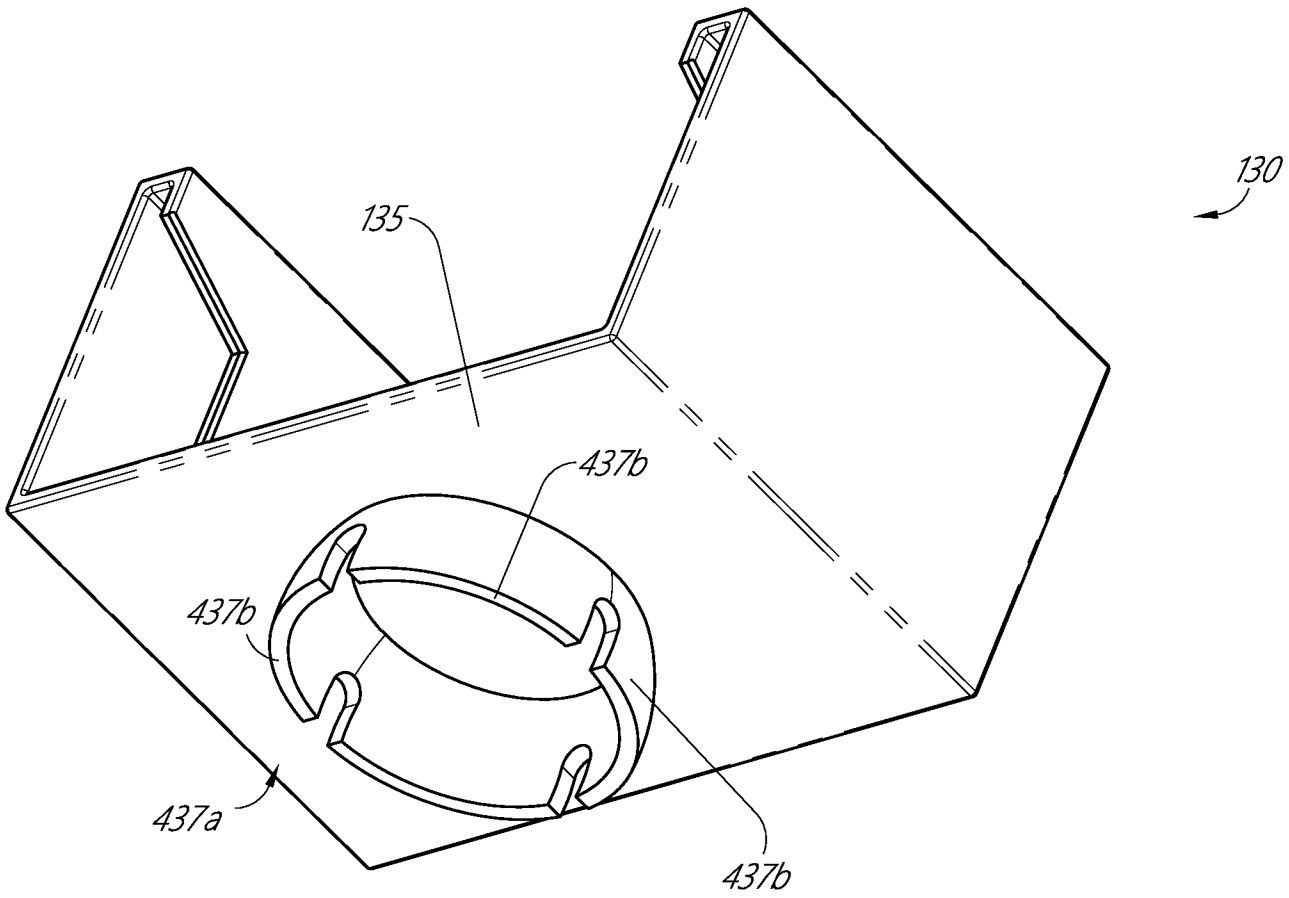
FIG. 14B illustrates a bottom perspective view of the track connector of FIG. 14A.
Figure 14C:
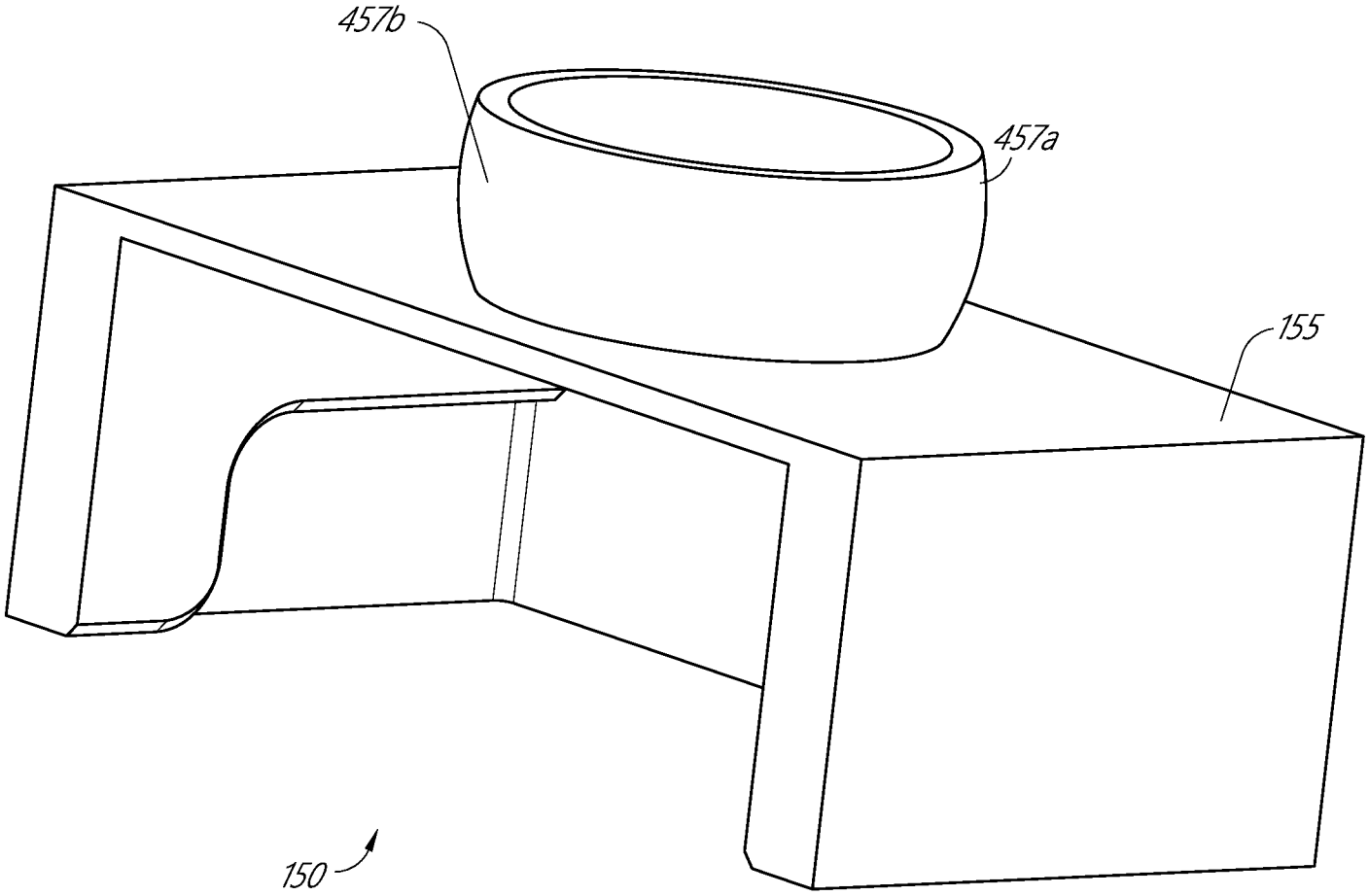
FIG. 14C illustrates a top perspective view of the support of FIG. 14A.

As shown in FIGS. 14A-14C, in some implementations the connector 130 can be coupled with the interchangeable support 150 by a ball and socket joint 457. The ball and socket joint 457 can include a socket 437*a* and a ball 457*a*. In some implementations the socket 437*a* can be on the connector 130 attached to the base wall 135 and the ball 457*a* can be on an upper wall 155 of the interchangeable support 150. In other implementations, the positions of the ball 457*a* and socket 437*a* can be reversed. In other implementations, the ball and socket joint 457 can be coupled to another portion of the walls of the connector 130 and/or interchangeable support 150. The socket 437*a* can engage an outer spherical surface 457*b* of the ball 457*a*. In some implementations, the socket 437*a* can include one or more flexible fingers or flanges 437*b* to aid assembly of the ball and socket joint 457. The ball and socket joint 457 allows for the track system 100 to be assembled at an angle which can allow for curves and banks of the raceway 105.

Figure 15:
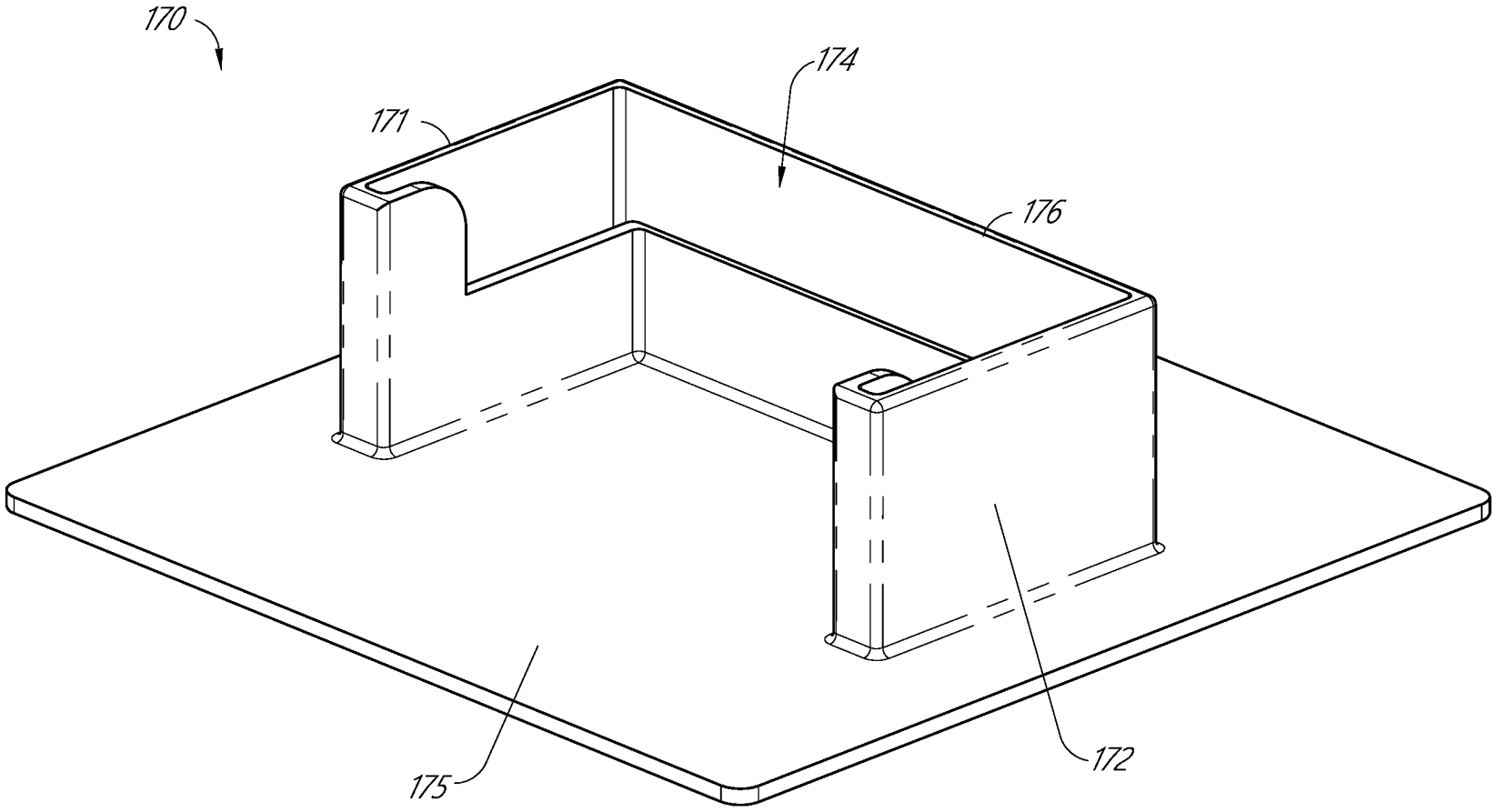
FIG. 15 illustrates a top perspective view of a base.

FIG. 15 illustrates the base 170. The base 170 can include a slot 174. In some implementations, the slot 174 can be generally U-shaped and correspond to the general U-shape of the straight track segment 110 (e.g., elongate support segments 160). The base 170 can include left and right walls 171, 172 connected by a base plate 175 and/or a connecting wall 176. The base plate 175 can be substantially planar and have a height and width sufficient to provide some stability to the elongate support segments 160. In one non-limiting implementation, the height and width of the base plate 175 are both between 1.5 inches and 4.5 inches.

Figure 16A:
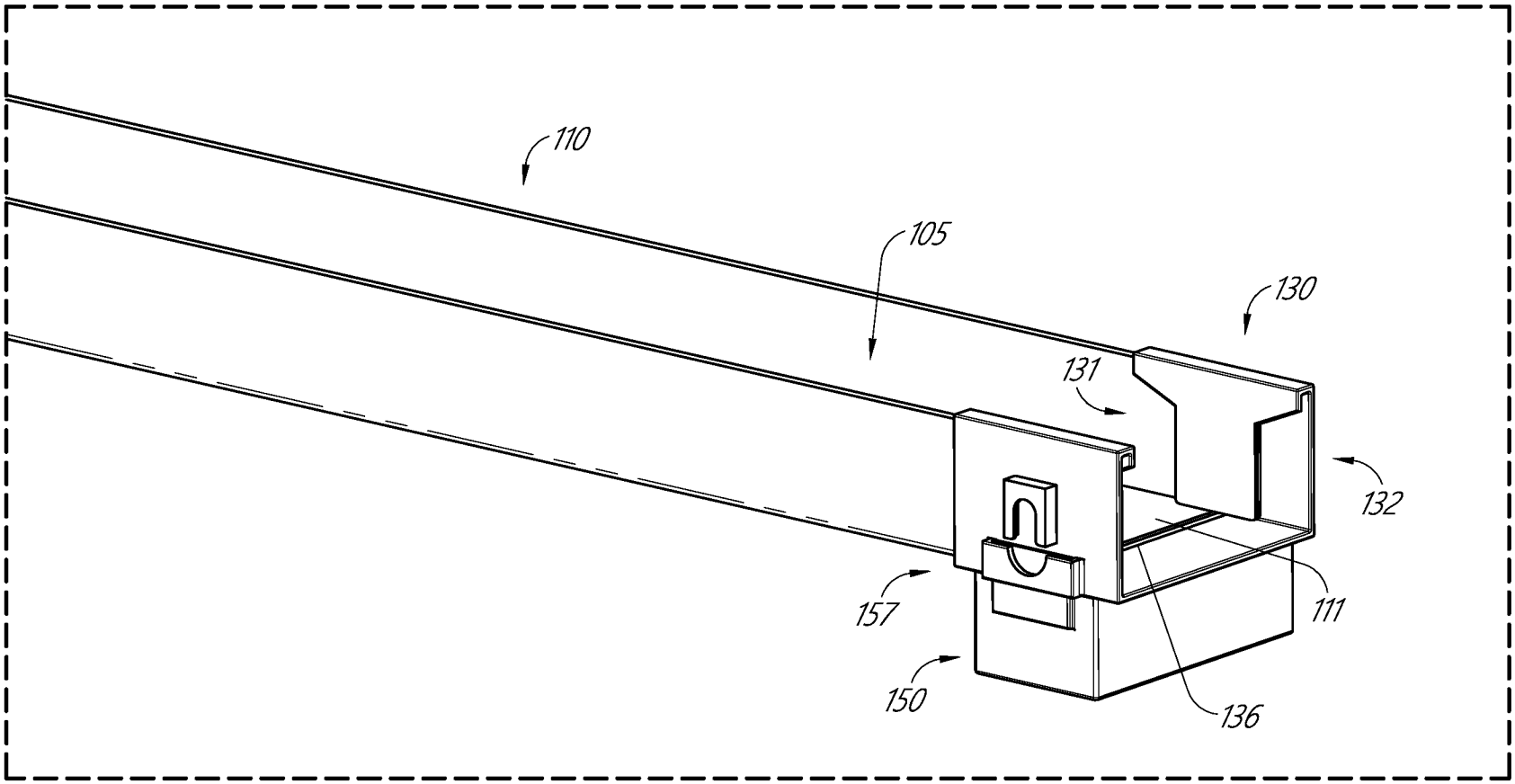
FIG. 16A illustrates an assembly of track components.
Figure 16B:
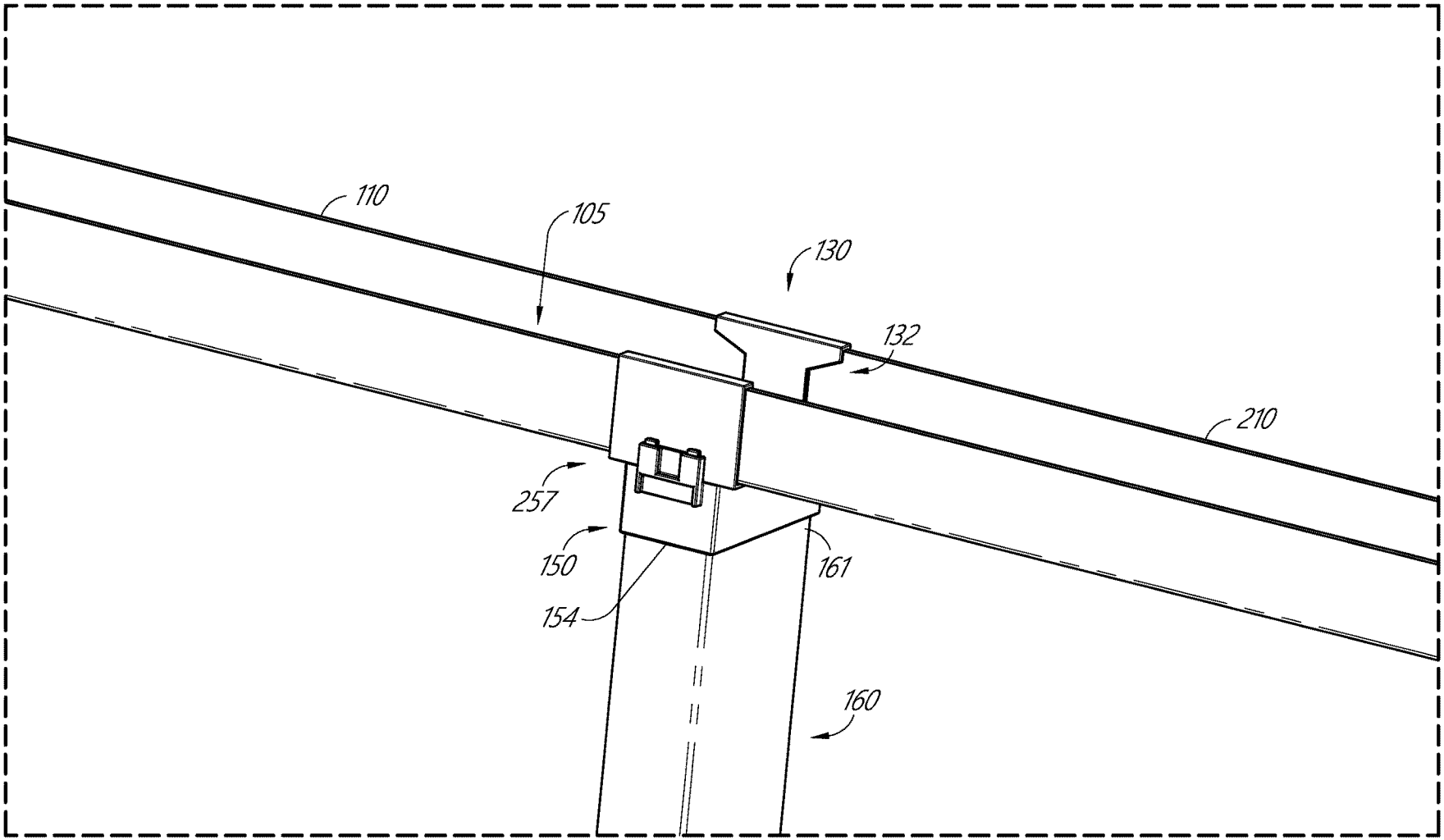
FIG. 16B illustrates another assembly of track components.

FIGS. 16A and 16B illustrate assemblies of one potential configuration of the track system 100 with the straight track segment 110 coupled with the connector 130. The first end 111 of the straight track segment 110 can be inserted on the first receiving end 131 of the connector 130. The interchangeable support 150 can be coupled with the connector 130 by the securing clip 157. The second straight track segment 210 can be inserted on the second receiving end 132 of the connector 130.

As illustrated in FIG. 16B, the clip 257 couples the connector 130 with the interchangeable support 150. In addition, the elongate support segment 160 (e.g., a straight track segment 110) is utilized as vertical support to provide elevation to the raceway 105. One end 161 is inserted into the receiving slots 156, 158 of the interchangeable support 150. The first end 111 of the straight track segment 110 can be abutted against the ridge 136 of the connector 130 for alignment purposes. The upright sides 113, 114 of the first end 111 are at least partially inserted into the slots 133*b*, 134*b* of the connector 130. Optionally, the first end 111 can be abutted against the vertical ridges 136*a*, 136*b* (not illustrated).

Figure 16C:
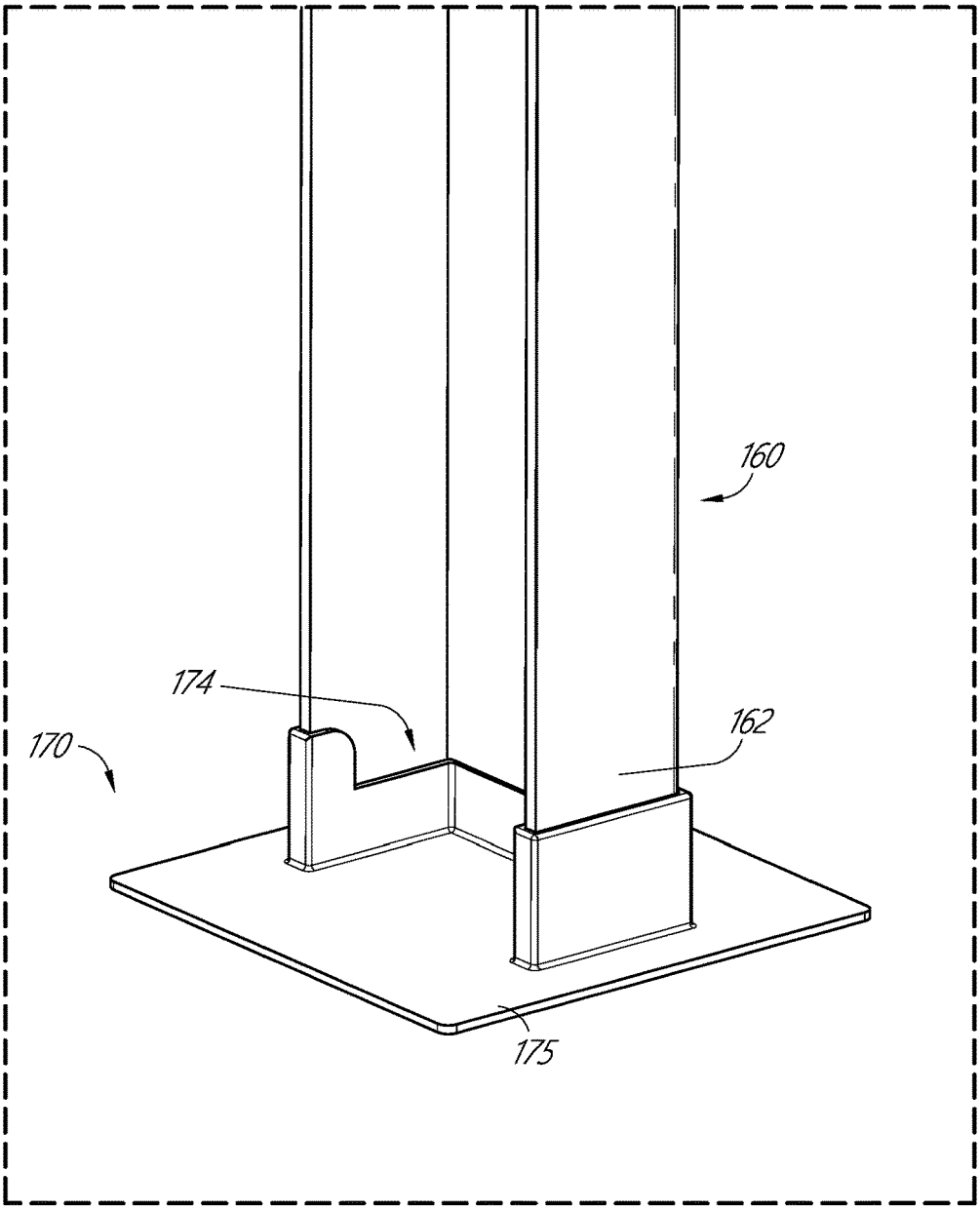
FIG. 16C illustrates another assembly of track components showing the base of FIG. 15.

FIG. 16C illustrates a second end 162 of the elongate support 160 inserted into the base 170. In particular, the second end 162 is inserted into the generally U-shaped channel 174, and the base plate 175 can provide stability to the connector 130 with the first straight track segment 110 and the second straight track segment 210.

Figure 16D:
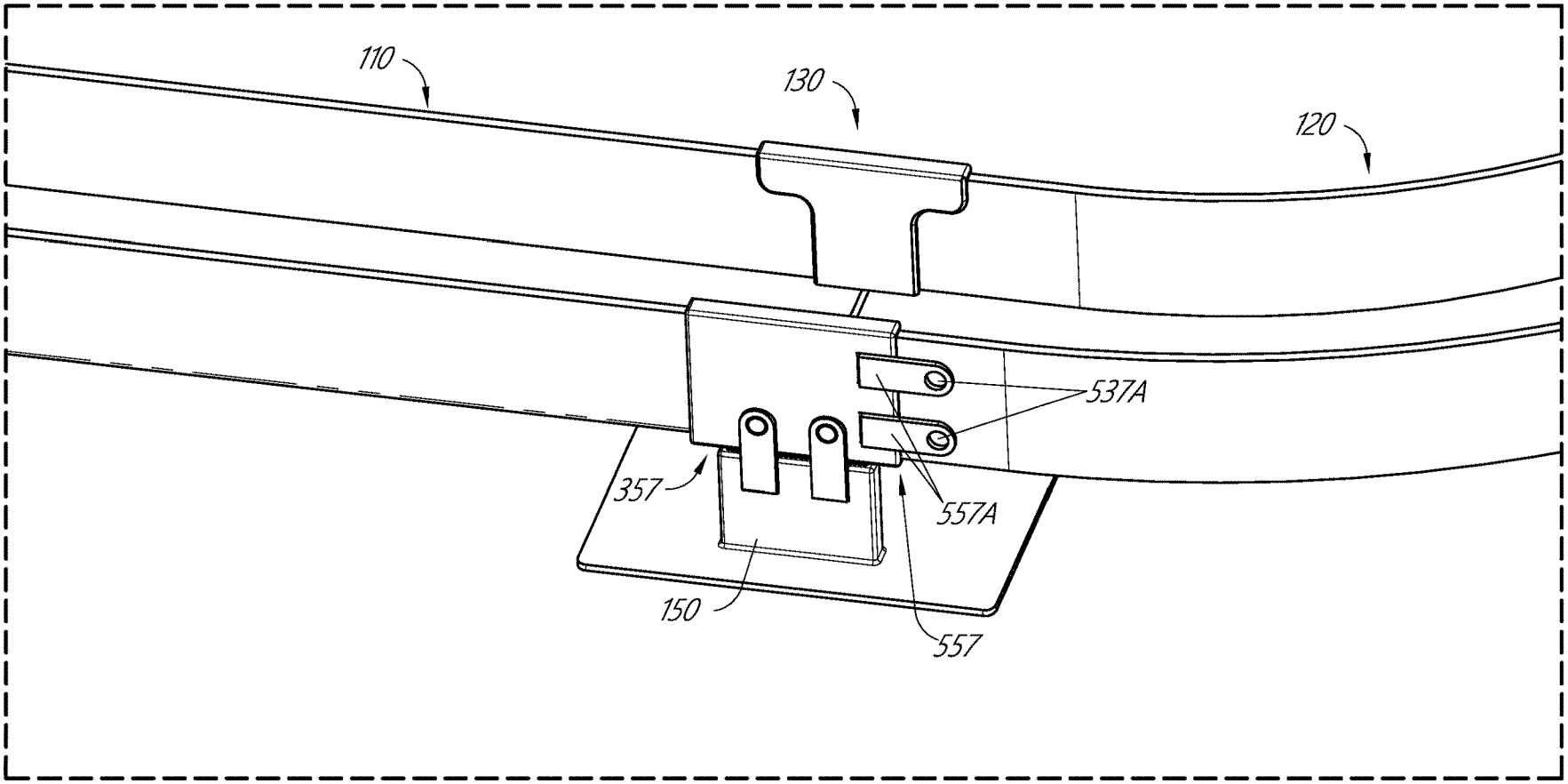
FIG. 16D illustrates another assembly of track components showing another securing clip.

FIG. 16D illustrates the clip 357 coupling the interchangeable support 150 with the connector 130. In addition, a second clip 557 couples the connector 130 with the curved segment 120. In this implementation, the clip 557 includes flexible eyelets 557*a* coupled with one or more pegs 537*a* on the curved track segment 120. In other implementations, the positions can be reversed for the components of the clip 557. The clip 557 can be utilized to more securely clip together the curved track segment 120 with the connector 130. This can be done with the curved track segment 120 where it is made of molded plastic (e.g., pegs 537*a* or flexible eyelets 557*a* can be molded easily as a part thereof).

Figure 16E:
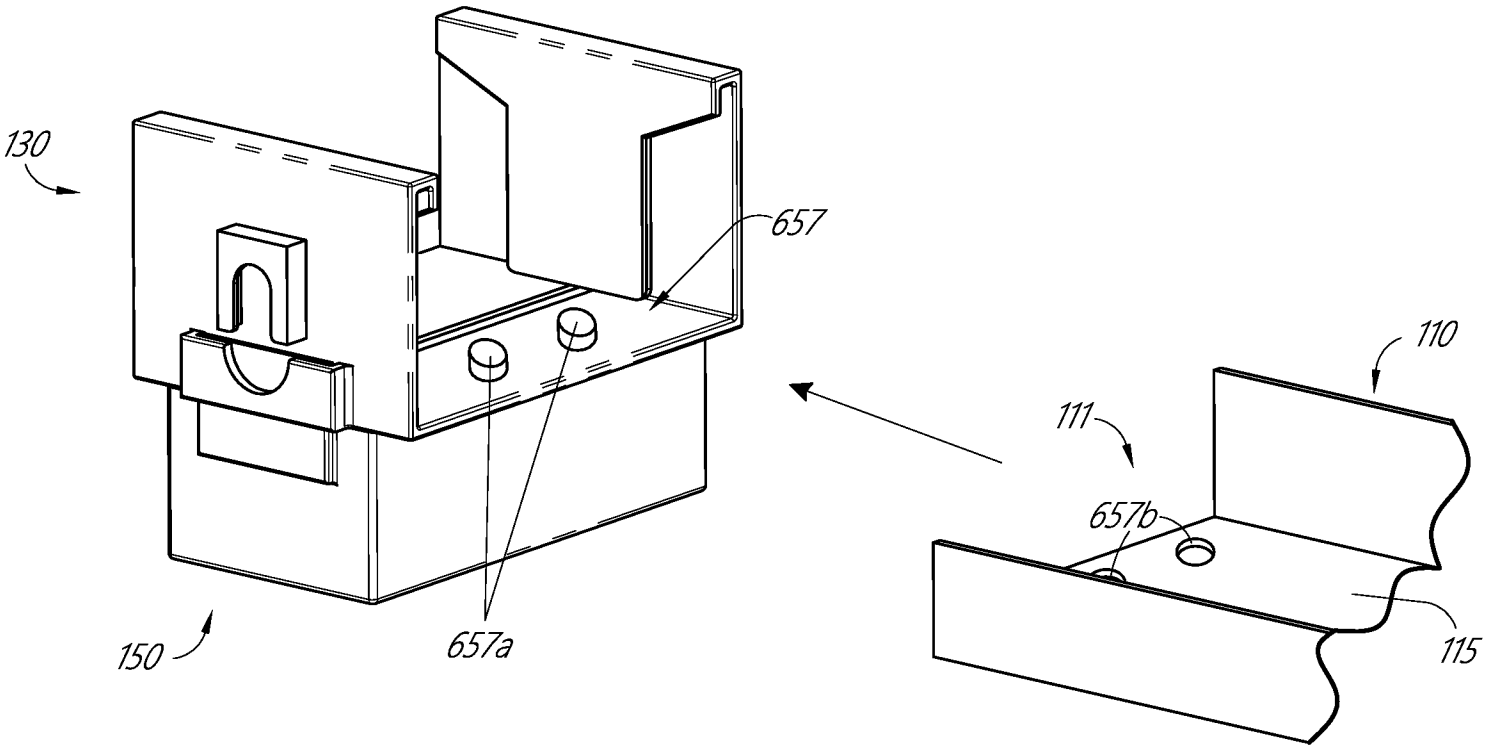
FIG. 16E illustrates another assembly of track components showing another securing clip.
Figure 16F:
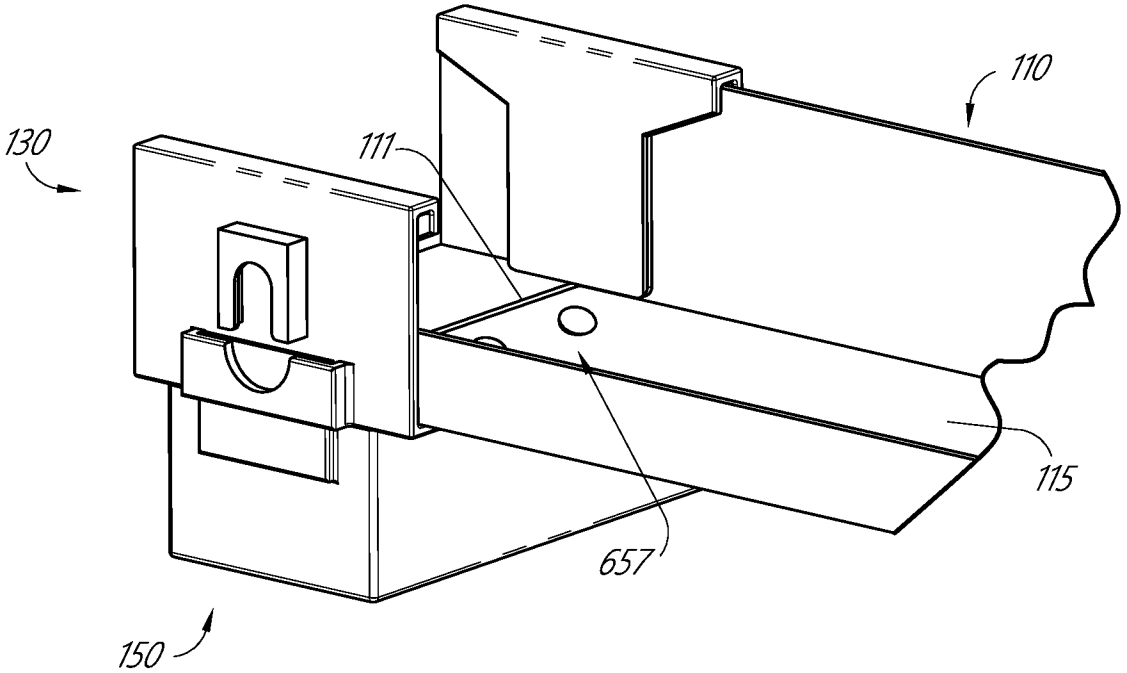
FIG. 16F illustrates an assembly configuration of the assembly of FIG. 16E.

FIGS. 16E and 16F illustrate another connection mechanism between the connector 130 and track segment 110 (or another track segment such as curved track segment 120). The connector 130 can be coupled with the straight track segment 110 by a clip 657. The clip 657 can include one or more pegs 657*a* on the upper surface 135*a* of the base wall 135. Corresponding holes 657*b* can be perforated through the base 115 of the straight track segment 110 (or base 125), or pre-perforated holes in the base 115 can be punched out by the assembler. As the first end 111 of the straight track segment 110 is inserted into the connector 130 on the first or second receiving ends 131, 132, the holes 657*b* can be aligned with and disposed over the pegs 657*a* to more securely couple together the straight track segment 110 with the connector 130. In one implementation, the pegs 657*a* comprise an angle towards the outer edge of the base wall 135. The angle on the pegs 657*a* can aid assembly with the holes 657*b* (e.g., can act as ramp during assembly). The total height of the pegs 657*a* should generally be less than the total thickness of the base 115 (e.g., to prevent the pegs 657*a* from obstructing the raceway 105).

Figure 17A:
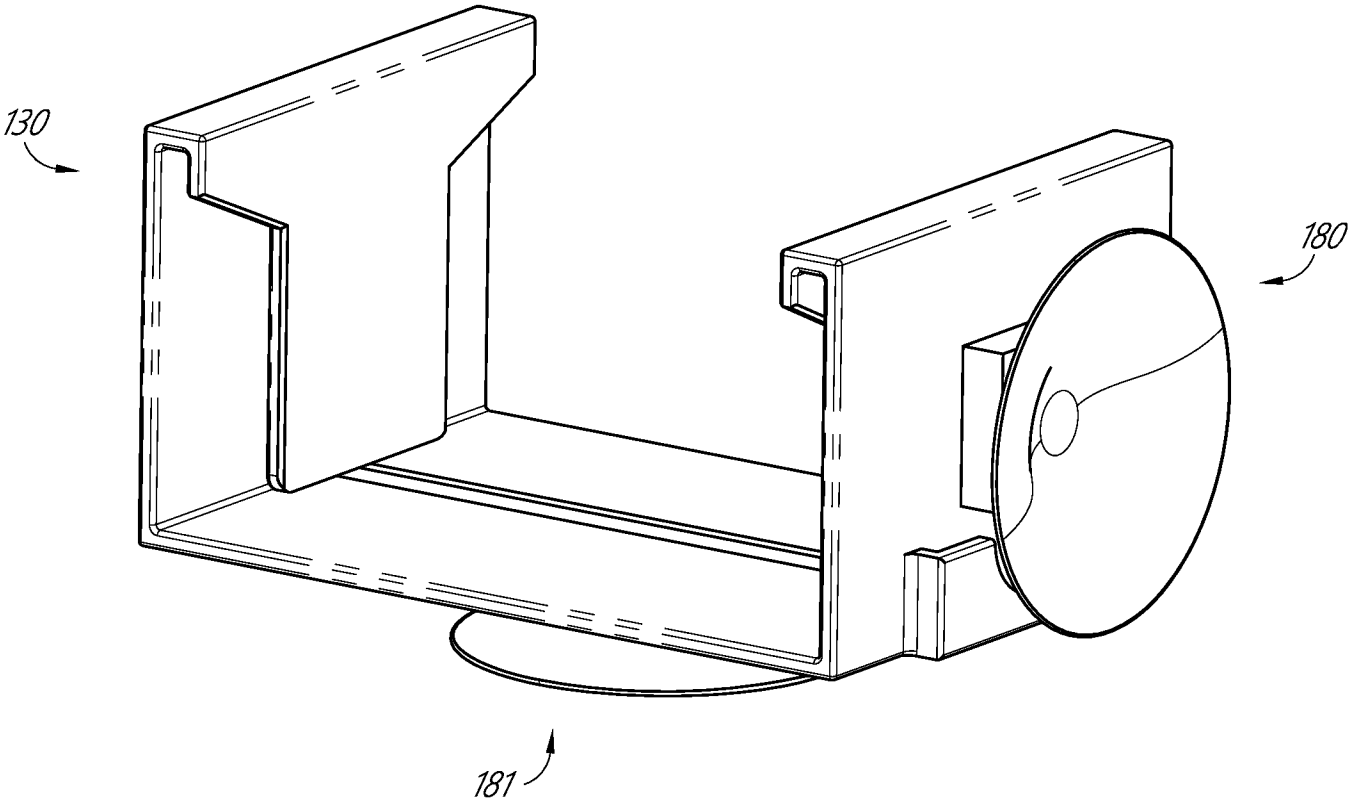
FIG. 17A illustrates a track connector with one or more suction cups.

FIG. 17A illustrates the connector 130 with a suction cup 180. The suction cup 180 can include a rear flange that can be coupled within the mounting coupler 138 (e.g., within the slot of the mounting coupler 138). This can allow for the connector 130 to be coupled with any flat surface, such as to provide elevation to the raceway 105. The mounting coupler 138 can be on any side or bottom of the connector 130. For example, this can allow for each portion of the track system 100 to be suspended off of a wall or a table or any other kind of flat surface (e.g., window, refrigerator) and greatly increases the flexibility and configurability of the track system 100.

Figure 17B:
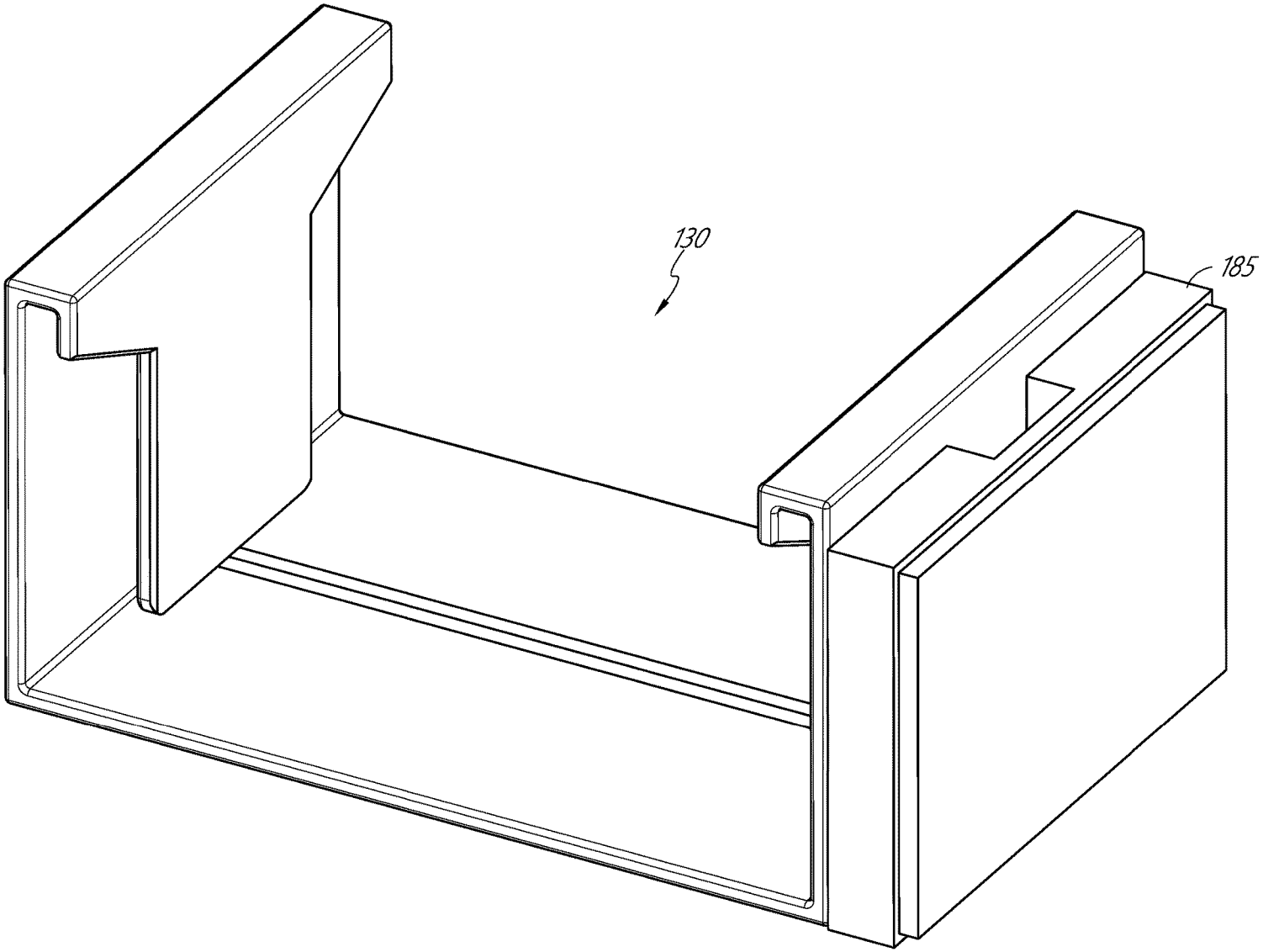
FIG. 17B illustrates a perspective view of a track connector with a magnetic coupler.

FIG. 17B illustrates a similar concept with a magnet assembly 185 coupled with the connector 130. The magnet assembly 185 can include a flange for coupling within the mounting coupler 138. This can be on any side or bottom of the connector 130 and can be coupled with the fridge or any other (ferrous) metal object.

Figure 18:
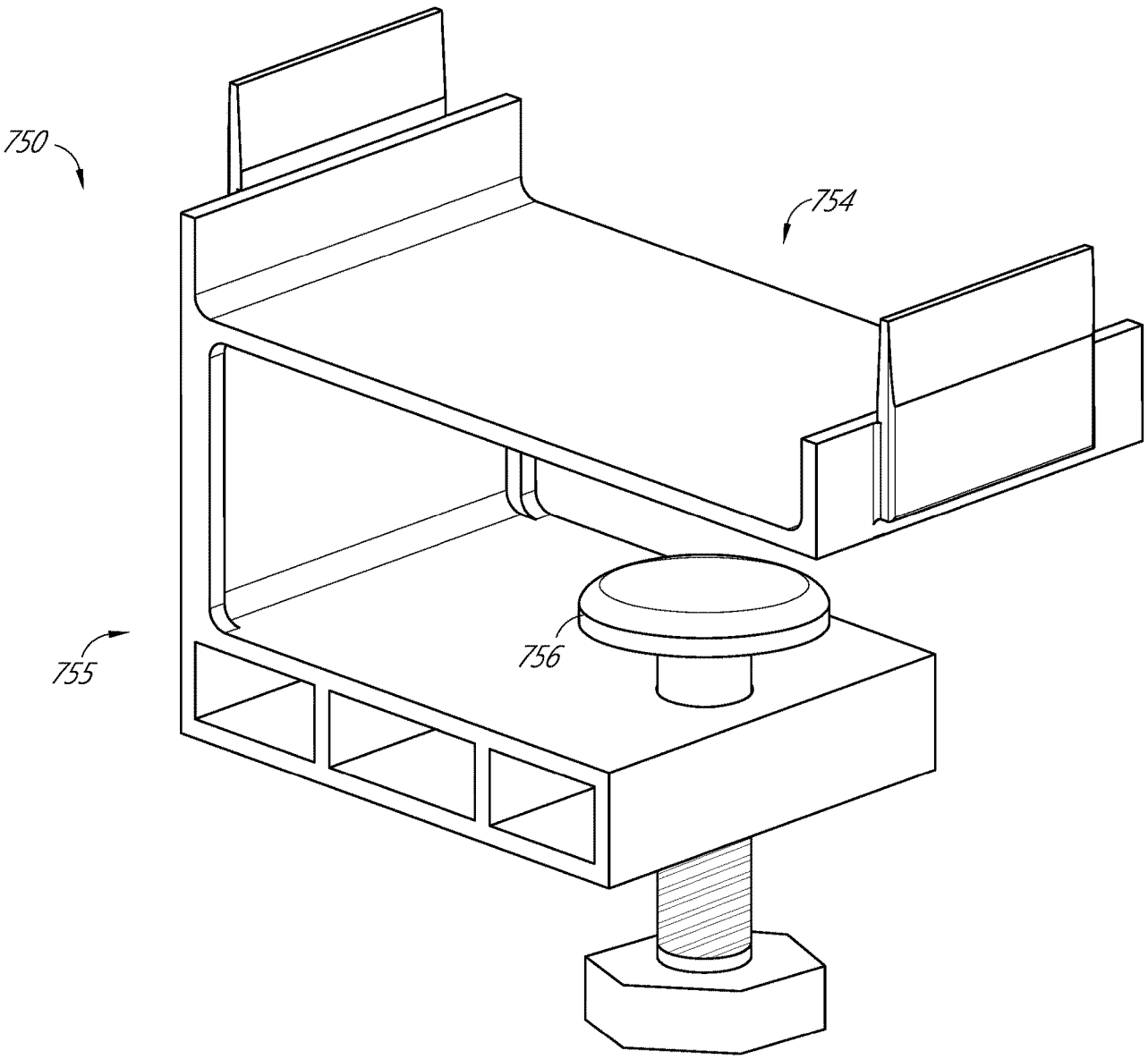
FIG. 18 illustrates a support formed as a C-clamp.

FIG. 18 illustrates a support 750. Support 750 includes a lower portion 755 that is a C-clamp and an upper portion 754 that couples with the connector 130 (e.g., securing clip 157). A threaded bolt 756 is coupled with the lower portion 755 in a manner that engages the threads of the threaded bolt 756. The C-clamp can be coupled with other objections (e.g., tabletops or shelves) to provide support to the raceway 705. This increases modularity and configurability of the track system 100 to the play area.

While certain embodiments of the inventions have been described, these embodiments have been presented by way of example only and are not intended to limit the scope of the disclosure. Indeed, the novel methods and systems described herein may be embodied in a variety of other forms. Furthermore, various omissions, substitutions and changes in the systems and methods described herein may be made without departing from the spirit of the disclosure. The accompanying claims and their equivalents are intended to cover such forms or modifications as would fall within the scope and spirit of the disclosure. Accordingly, the scope of the present inventions is defined only by reference to the appended claims.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a subcombination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Further, the operations may be rearranged or reordered in other implementations. Those skilled in the art will appreciate that in some embodiments, the actual steps taken in the processes illustrated and/or disclosed may differ from those shown in the figures. Depending on the embodiment, certain of the steps described above may be removed, others may be added. Furthermore, the features and attributes of the specific embodiments disclosed above may be combined in different ways to form additional embodiments, all of which fall within the scope of the present disclosure. Also, the separation of various system components in the implementations described above should not be understood as requiring such separation in all implementations, and it should be understood that the described components and systems can generally be integrated together in a single product or packaged into multiple products.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of the stated amount. As another example, in certain embodiments, the terms "generally parallel" and "substantially parallel" refer to a value, amount, or characteristic that departs from exactly parallel by less than or equal to 15 degrees, 10 degrees, 5 degrees, 3 degrees, 1 degree, or 0.1 degree.

The scope of the present disclosure is not intended to be limited by the specific disclosures of preferred embodiments in this section or elsewhere in this specification, and may be defined by claims as presented in this section or elsewhere in this specification or as presented in the future. The language of the claims is to be interpreted broadly based on the language employed in the claims and not limited to the examples described in the present specification or during the prosecution of the application, which examples are to be construed as non-exclusive.

Of course, the foregoing description is that of certain features, aspects and advantages of the present invention, to which various changes and modifications can be made without departing from the spirit and scope of the present invention. Moreover, the race track need not feature all of the objects, advantages, features and aspects discussed above. Thus, for example, those of skill in the art will recognize that the invention can be embodied or carried out in a manner that achieves or optimizes one advantage or a group of advantages as taught herein without necessarily achieving other objects or advantages as may be taught or suggested herein. In addition, while a number of variations of the invention have been shown and described in detail, other modifications and methods of use, which are within the scope of this invention, will be readily apparent to those of skill in the art based upon this disclosure. It is contemplated that various combinations or subcombinations of these specific features and aspects of embodiments may be made and still fall within the scope of the invention. Accordingly, it should be understood that various features and aspects of the disclosed embodiments can be combined with or substituted for one another in order to form varying modes of the discussed race track.

What is claimed is:

1. A kit for assembling a modular toy race track, comprising;

at least one straight track segment for providing a raceway, the straight track segment formed of paperboard and including a plurality of fold lines, the paperboard and fold lines configured to form a generally U-shaped channel with a pair of upright walls defined by folded sides and a base connecting the pair of upright walls;

at least one curved track segment, the curved track segment formed of one of a molded plastic and a thermoformed paper pulp, the curved track segment forming a generally U-shaped channel with a pair of upright walls and a base connecting the pair of upright walls; and at least one track connectors for interconnecting a pair of track segments, each of the track connectors having first and second connection sides on opposite ends of the track connector for coupling together two track segments selected from the group consisting of: two straight track segments, two curved track segments, and one straight track segment and one curved track segment, the first connection side configured to at least partially receive one of the two track segments and the second connection side configured to at least partially receive another of the two track segments to thereby form the raceway, the track connector formed of a molded plastic, the track connector comprising:

a left wall, a right wall, and a base wall that extends between and interconnects the left wall to the right wall, a first wing spaced from and generally parallel to the left wall to define a first slot therebetween, a second wing spaced from and generally parallel to the right wall to define a second slot therebetween, the second wing facing the first wing, and a pair of securing clips on an outer surface of the left and right walls configured to attach to interchangeable supports of varying size to vary a height of the track connector above a support surface, wherein the first and second slots are configured to receive the pair of upright walls of one of the two track segments via the first connection side on one end of the track connector and the first and second slots are configured to receive the pair of upright walls of the other of the two track segments via the second connection side on an opposite end of the track connector to thereby interconnect the two track segments, and wherein the track connectors further comprises an alignment ridge on the base wall for aligning the ends of the two track segments inserted into the first and second connection sides of the track connector, the alignment ridge extending between the first and second wings.

2. The kit for assembling a race track of claim 1, wherein a vertical ridge is disposed within each of the first and second slots of the track connector, the vertical ridges aligned with the alignment ridge.

3. The kit for assembling a race track of claim 1, wherein the base wall of the track connector further comprises one or more pegs for retaining the ends of the two track segments within the track connector, the pegs disposed on an upper surface of the base wall and corresponding holes disposed in the ends of the two track segments such that when the ends of the track segments are inserted into the track connector, the holes are disposed over the pegs.

4. The kit for assembling a race track of claim 1, further comprising: a second straight track segment, the second straight track segment formed of paperboard and including a plurality of fold lines, the paperboard and fold lines configured to form a generally U-shaped channel with a pair of upright walls defined by folded sides and a base connecting the pair of upright walls;

wherein the interchangeable support is configured to receive an end of the second straight track segment to provide support and elevation to the track connector, the support comprising first and second slots on respective first and second ends of the support, the first and second slots configured to receive the first and second folded sides of the second straight track segment.

5. The kit for assembling a race track of claim 4, further comprising a base for providing stability and elevation to the second straight track, the base having a base plate and a receiving slot, the receiving slot configured for receiving a second end of the second straight track segment.

6. The kit for assembling a race track of claim 1, wherein the track connector further comprises a mounting coupler on one of the left and right walls, the mounting coupler configured to removably couple with one of a magnet connector and a suction cup for mounting the track connector.

7. A kit for assembling a modular toy race track, comprising;

at least one straight track segment for providing a raceway, the straight track segment formed of paperboard and including a plurality of fold lines, the paperboard and fold lines configured to form a generally U-shaped channel with a pair of upright walls defined by folded sides and a base connecting the pair of upright walls;

at least one curved track segment, the curved track segment formed of one of a molded plastic and a thermoformed paper pulp, the curved track segment forming a generally U-shaped channel with a pair of upright walls and a base connecting the pair of upright walls;

at least one track connectors for interconnecting a pair of track segments, each of the track connectors having first and second connection sides on opposite ends of the track connector for coupling together two track segments selected from the group consisting of: two straight track segments, two curved track segments, and one straight track segment and one curved track segment, the first connection side configured to at least partially receive one of the two track segments and the second connection side configured to at least partially receive another of the two track segments to thereby form the raceway, the track connector formed of a molded plastic, the track connector comprising:

a left wall, a right wall, and a base wall that extends between and interconnects the left wall to the right wall;

a first wing spaced from and generally parallel to the left wall to define a first slot therebetween;

a second wing spaced from and generally parallel to the right wall to define a second slot therebetween, the second wing facing the first wing; and a pair of securing clips on an outer surface of the left and right walls configured to attach to interchangeable supports of varying size to vary a height of the track connector above a support surface; and a second straight track segment, the second straight track segment formed of paperboard and including a plurality of fold lines, the paperboard and fold lines configured to form a generally U-shaped channel with a pair of upright walls defined by folded sides and a base connecting the pair of upright walls, wherein the interchangeable support is configured to receive an end of the second straight track segment to provide support and elevation to the track connector, the support comprising first and second slots on respective first and second ends of the support, the first and second slots configured to receive the first and second folded sides of the second straight track segment, and wherein the first and second slots are configured to receive the pair of upright walls of one of the two track segments via the first connection side on one end of the track connector and the first and second slots are configured to receive the pair of upright walls of the other of the two track segments via the second connection side on an opposite end of the track connector to thereby interconnect the two track segments.

8. The kit for assembling a race track of claim 7, wherein the track connectors further comprises an alignment ridge on the base wall for aligning the ends of the two track segments inserted into the first and second connection sides of the track connector, the alignment ridge extending between the first and second wings.

9. The kit for assembling a race track of claim 8, wherein a vertical ridge is disposed within each of the first and second slots of the track connector, the vertical ridges aligned with the alignment ridge.

10. The kit for assembling a race track of claim 7, wherein the base wall of the track connector further comprises one or more pegs for retaining the ends of the two track segments within the track connector, the pegs disposed on an upper surface of the base wall and corresponding holes disposed in the ends of the two track segments such that when the ends of the track segments are inserted into the track connector, the holes are disposed over the pegs.

11. The kit for assembling a race track of claim 7, further comprising a base for providing stability and elevation to the second straight track, the base having a base plate and a receiving slot, the receiving slot configured for receiving a second end of the second straight track segment.

12. The kit for assembling a race track of claim 7, wherein the track connector further comprises a mounting coupler on one of the left and right walls, the mounting coupler configured to removably couple with one of a magnet connector and a suction cup for mounting the track connector.

* * * * *